US006592418B2

(12) United States Patent
Ito et al.

(10) Patent No.: US 6,592,418 B2
(45) Date of Patent: Jul. 15, 2003

(54) METHOD FOR MANUFACTURING SPARK PLUG AND APPARATUS FOR CARRYING OUT THE SAME

(75) Inventors: Masato Ito, Aichi (JP); Shinichiro Mitsumatsu, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/067,348

(22) Filed: Feb. 7, 2002

(65) Prior Publication Data

US 2002/0142696 A1 Oct. 3, 2002

(30) Foreign Application Priority Data

Feb. 8, 2001 (JP) ..... 2001-32271

(51) Int. Cl.[7] ..... H01T 21/02
(52) U.S. Cl. ..... 445/4; 445/7
(58) Field of Search ..... 439/3, 4, 7, 64, 439/67

(56) References Cited

U.S. PATENT DOCUMENTS

| | | | | |
|---|---|---|---|---|
| 5,728,408 A | * | 3/1998 | Nakatani | 445/4 |
| 5,741,963 A | * | 4/1998 | Nakatani et al. | 445/7 |
| 6,193,575 B1 | * | 2/2001 | Nakatani | 445/4 |

FOREIGN PATENT DOCUMENTS

| | | |
|---|---|---|
| JP | 6-58820 | 8/1994 |
| JP | 2000-164320 | 6/2000 |
| JP | 2000-164321 | 6/2000 |
| JP | 2000-164322 | 6/2000 |
| WO | WO 01/93389 A1 | 12/2001 |

* cited by examiner

*Primary Examiner*—Gary Paumen
(74) *Attorney, Agent, or Firm*—Sughrue Mion, PLLC

(57) ABSTRACT

A method for manufacturing a spark plug that can calculate, in measurement of a gap, an accurate gap regardless of inclination of a workpiece (a spark plug) with respect to a measurement device and can manufacture the spark plug at high accuracy as well. Also disclosed is an apparatus for carrying out the same. A plurality of measurement points are determined on the outline (tip edge $E_2$) of a ground electrode spark gap definition portion of a ground electrode $W_2$ facing a spark gap and on the outline (tip edge $E_1$) of a center electrode spark gap definition portion of a center electrode $W_1$. The measurement points represent the outlines of the respective spark gap definition portions. A single measurement point on the outline of one spark gap definition portion is selected as a reference point. A measurement point on the outline of the other spark gap definition portion is found such that the distance between the measurement point and the reference point is the shortest. The gap is determined based on the shortest distance.

16 Claims, 19 Drawing Sheets

[FIG. 17]

METHOD FOR MANUFACTURING SPARK PLUG AND APPARATUS FOR CARRYING OUT THE SAME

BACKGROUND OF THE INVENTION

1. Field of the Invention

The present invention relates to a method for manufacturing a spark plug and an apparatus for carrying out the same.

2. Description of the Related Art

Conventionally, in manufacture of a so-called parallel-electrode-type spark plug, a spark gap is formed and adjusted in the following manner: after a ground electrode is subjected to preliminary pressing, the ground electrode is repeatedly subjected to pressing while the gap is being monitored by use of a CCD camera or a like device, until the gap reaches a target value.

3. Problems to be Solved by the Invention

When a gap is to be monitored by use of a CCD camera or a like device for the purpose of adjusting the gap, the installation direction of a spark plug (specifically, the direction of the axis of a center electrode) is determined so as to comply with a coordinate system of an image obtained through photographing. That is, when a measurement technique to be used is such that the direction of any one coordinate axis (e.g., the Y direction) of the coordinate system coincides with the direction of the center electrode, a gap is obtained by measuring the distance along the coincident direction between edges of the center electrode and a ground electrode.

However, as shown in FIG. 20, when a workpiece W is photographed while the axis of the center electrode is inclined with respect to a reference direction of the gap measurement (the Y direction in the figure) (specifically, while the axis is inclined laterally with respect to the direction of photographing by photographing means), the direction along which a gap must be measured is inclined with respect to the reference direction. Accordingly, the inclination may result in a dimensional error between an actual value $g_r$ and measured value g" obtained from the image. Also, as shown in FIG. 8, when the workpiece is photographed while the axis is inclined along the direction of photographing by the photographing means, a dimensional error may similarly arise.

SUMMARY OF THE INVENTION

An object of the present invention is to provide a method for manufacturing a spark plug that can determine an accurate gap regardless of inclination of a workpiece (a spark plug) with respect to the measuring means and can manufacture the spark plug at high accuracy by use of the calculated gap, as well as to provide an apparatus for carrying out the same.

The above object of the present invention has been achieved by providing a method (and apparatus) for manufacturing a spark plug comprising a center electrode disposed within an insulator, a metallic shell disposed outside the insulator, and a ground electrode, one end of the ground electrode being joined to an end face of the metallic shell, an opposite end portion of the ground electrode being bent such that a side surface of the opposite end portion faces an end face of the center electrode so as to form a spark gap between the side surface and the end face, said method (apparatus) comprising:

a photographing step (photographing means) for photographing the spark gap;

a gap calculation step (gap calculation means) for determining a gap which comprises defining a reference point on the basis of image information obtained from said photographing step, defining a plurality of measurement lines passing through the reference point, measuring along each of the measurement lines a distance between a ground electrode spark gap definition portion of the ground electrode facing the spark gap and a center electrode spark gap definition portion of the center electrode facing the spark gap, and determining a gap on the basis of the measured distance; and an after-treatment step (after-treatment means) for performing a predetermined after-treatment on the basis of the calculated gap.

Since the gap is determined in the above-described manner, the gap can be measured accurately, even when a spark plug is photographed in such a manner as to be inclined on the captured image as shown in FIG. 20; i.e., even when the axis of the center electrode of the spark plug is inclined laterally on the plane of the image. That is, the inclination of a spark plug on the plane of image does not result in a dimensional error.

The present invention further provides a method (apparatus) for manufacturing a spark plug comprising a center electrode disposed within an insulator, a metallic shell disposed outside the insulator, and a ground electrode, one end of the ground electrode being joined to an end face of the metallic shell, an opposite end portion of the ground electrode being bent such that a side surface of the opposite end portion faces an end face of the center electrode so as to form a spark gap between the side surface and the end face, the method (apparatus) comprising:

a photographing step (photographing means) for photographing the spark gap;

a gap calculation step (gap calculation step) for determining a gap which comprises determining, on the basis of image information obtained from the photographing step, a single reference point on the outline of either a ground electrode spark gap definition portion of the ground electrode facing the spark gap or a center electrode spark gap definition portion of the center electrode facing the spark gap, finding a measurement point on the outline of the other spark gap definition portion such that the distance between the reference point and the measurement point is the shortest, and determining the gap on the basis of the shortest distance; and an after-treatment step (after-treatment means) for performing a predetermined after-treatment on the basis of the calculated gap.

Since the gap is determined in the above-described manner, the shortest distance across the gap can be obtained at high accuracy. That is, the inclination of a spark plug on the plane of image does not result in a dimensional error, thereby contributing to highly accurate gap adjustment.

Alternatively, the method for manufacturing a spark plug may comprise obtaining an apparent size of a gap (hereinafter also called an "apparent gap size") as observed on an image obtained through photographing; and correcting the apparent gap size on the basis of an apparent dimension of a predetermined measurement reference portion of the spark plug (hereinafter also called a "measurement reference portion apparent-dimension") as observed on the captured image and a known standard dimension of the measurement reference portion (hereinafter also called a "measurement reference portion standard-dimension"), to thereby calculate the gap. Specifically, for example, the method corrects a dimensional error in the apparent gap size associated with the spark plug being photographed while being inclined along the direction of photographing by photographing means, on the basis of the measured reference portion apparent-dimension and the measured reference portion standard-dimension.

According to the method described above, even when a spark plug is photographed while being inclined along the direction of photographing by photographing means, a value that is very close to an actual dimension can be obtained by correction, thereby enabling highly accurate establishment of a gap. Combined use of the above method and the previously described method, which calculates a gap on the basis of a measurement point and a reference point on outlines, can cope with the inclination of a spark plug along the direction of photographing and in a lateral direction with respect to the direction of photographing.

DESCRIPTION OF REFERENCE NUMERALS

1: apparatus for manufacturing spark plug
W: workpiece (spark plug)
$W_1$: center electrode
$W_2$: ground electrode
$W_3$: metallic shell
G: spark gap
g: spark gap size
g': apparent gap size
t: ground electrode standard-thickness
t': ground electrode apparent-thickness
w: standard width
4: camera (photographing means)
5: bending mechanism (gap adjustment means)
112: CPU (for implementing after-treatment means, gap calculation means, gap correction means, apparent gap size calculation means, electrode edge line determination means, smoothing means)

DETAILED DESCRIPTION OF THE PREFERRED EMBODIMENTS

Embodiments of the present invention will next be described with reference to the drawings. However, the present invention should not be construed as being limited thereto.

Figure 1:
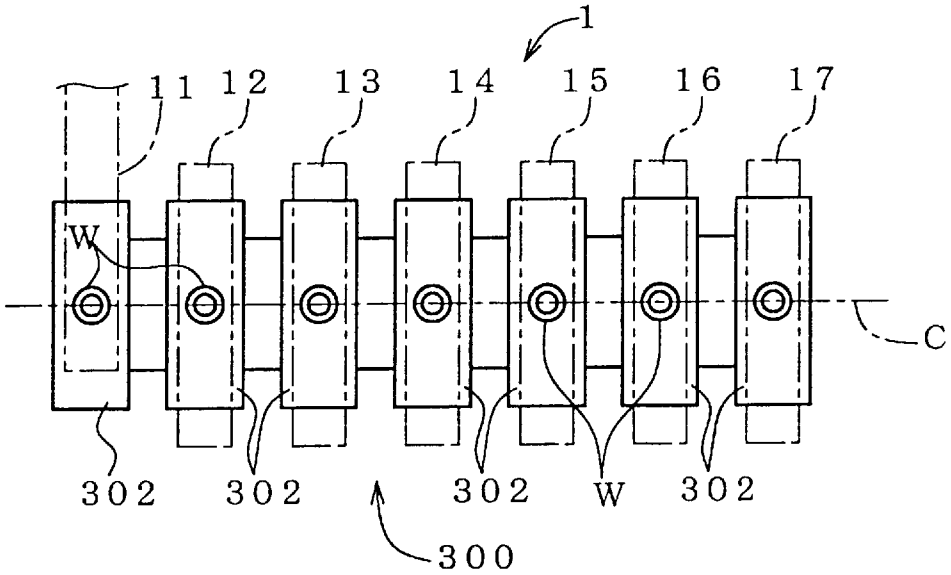
FIGS. 1(*a*) and 1(*b*) are plan and side views showing schematically an embodiment of an apparatus for manufacturing a spark plug of the present invention.
Figure 1:
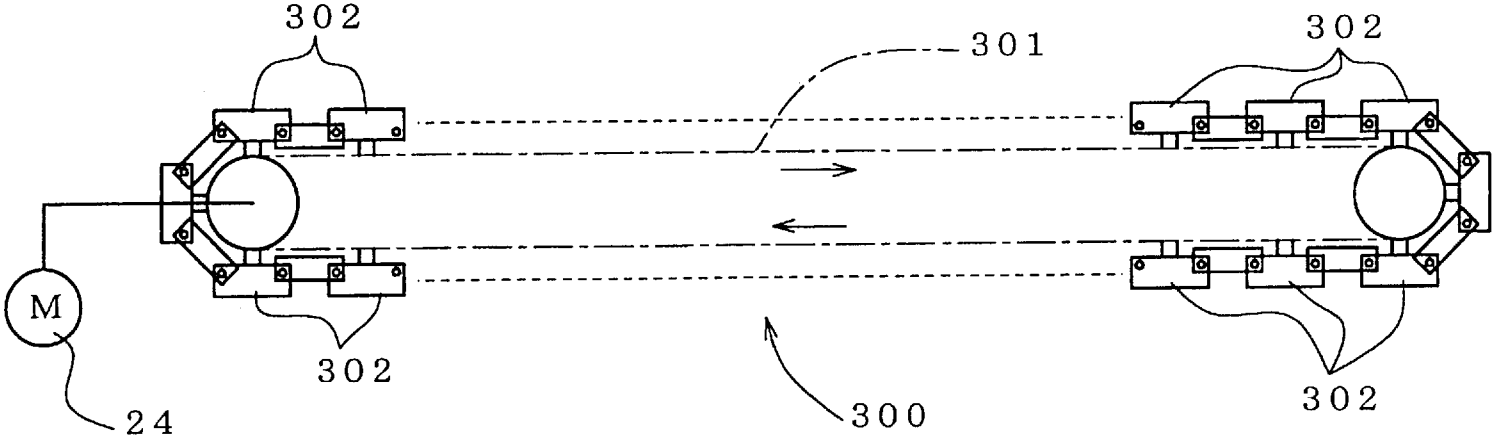

FIGS. 1(*a*) and 1(*b*) are a plan view and a side view, respectively, schematically showing an embodiment of an apparatus for manufacturing a spark plug (hereinafter, referred to as a manufacturing apparatus) of the present invention. A manufacturing apparatus 1 includes a linear conveyor 300, which serves as a conveyance mechanism for intermittently conveying spark plugs to undergo working (hereinafter, also called workpieces) W along a conveyance path C (a linear path in the present embodiment). Working stations for forming a spark gap of a workpiece W; i.e., a workpiece loading mechanism 11 for loading a spark plug to undergo working; a ground electrode positioning mechanism 12 for positioning the ground electrode of the workpiece W at a predetermined position; a tip face position measuring unit 13 for measuring the position of the tip face of a center electrode; a preliminary bending unit 14 for preliminarily bending the ground electrode; a main bending unit 15 for performing main bending work on the ground electrode; a workpiece ejection mechanism 16 for ejecting the workpiece W which has undergone the bending work; and a rejected-product ejection mechanism 17, are arranged in this order along the flow of conveyance along the conveyance path C. The linear conveyor 300 includes a chain 301, which serves as a circulating member, and carriers 302, which are removably loaded with the corresponding workpieces W and are attached to the chain 301 at predetermined intervals. As the chain 301 is intermittently driven in a circulating condition by means of a conveyor drive motor 24 (M), the carriers 302; i.e., the workpieces W, are intermittently conveyed along the conveyance path C.

Figure 2:
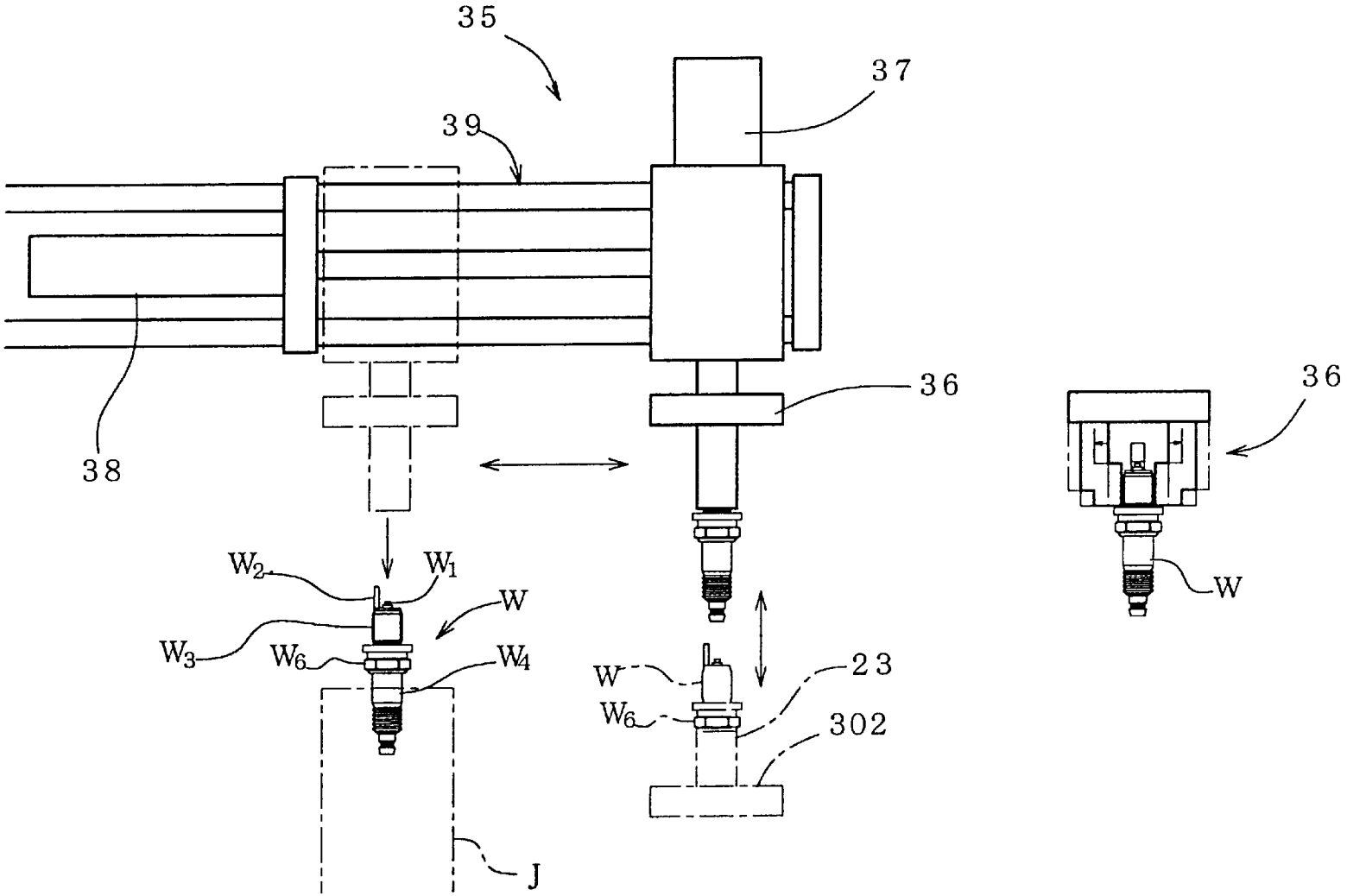
FIG. 2 is an explanatory view showing a transfer mechanism.

As shown in FIG. 2, the workpiece W includes a cylindrical metallic shell $W_3$; an insulator $W_4$, which is fitted into the metallic shell $W_3$ such that front and rear end portions thereof project from the metallic shell $W_3$; a center electrode $W_1$, which is axially inserted into the insulator $W_4$; and a ground electrode $W_2$, whose one end is joined to the metallic shell $W_3$ by welding or a like process and which extends along the axial direction of the center electrode $W_1$. The ground electrode $W_2$ undergoes bending work, which will be described below, such that a free end portion thereof is bent toward the tip face of the center electrode $W_1$ so as to form a spark gap, whereby the workpiece W becomes a parallel-electrode-type spark plug. A cylindrical holder 23 is integrally mounted on the top surface of each carrier 302 such that the top end thereof is open. The workpiece W is removably inserted, from a rear end thereof, into the holder 23. A hexagonal portion $W_6$ of the metallic shell $W_3$ is supported by a circumferential edge portion of an opening of the holder 23. Thus, the workpiece W is conveyed in a standing condition on the carrier 302 while the ground electrode $W_2$ faces up.

The workpiece loading mechanism 11, the workpiece ejection mechanism 16, and the rejected-product ejection mechanism 17 shown in FIG. 1 are each configured in the form of, for example, a transfer mechanism as shown in FIG. 2 for transferring the workpiece W between a workpiece supply section or a workpiece ejection section (provided at position J in FIG. 2) located laterally away from the conveyance path C of the linear conveyor 300 (FIG. 1) and the holder 23 which is positioned within the loading or ejection mechanism. The transfer mechanism 35 includes a chuck hand mechanism 36, which is held in such a manner as to be vertically movable through activation by an air cylinder 37, and a reciprocative drive mechanism 39 for causing the chuck hand mechanism 36 to reciprocate in a radial direction of a circumferential path C by use of an air cylinder 38.

Figure 3:
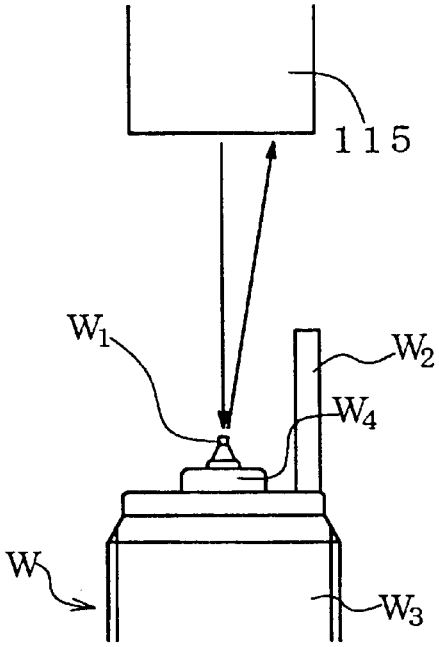
FIGS. 3(*a*), 3(*b*) and 3(*c*) are explanatory views showing the concept of operation of a tip face position measuring unit and a preliminary bending unit.
Figure 3:
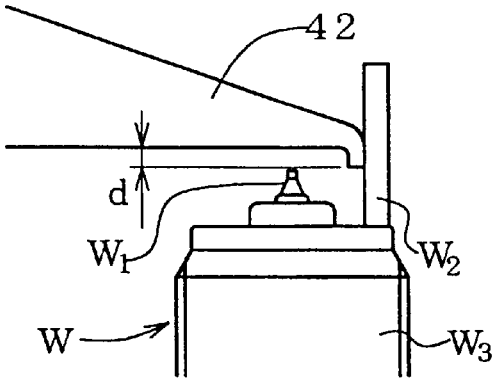
Figure 3:
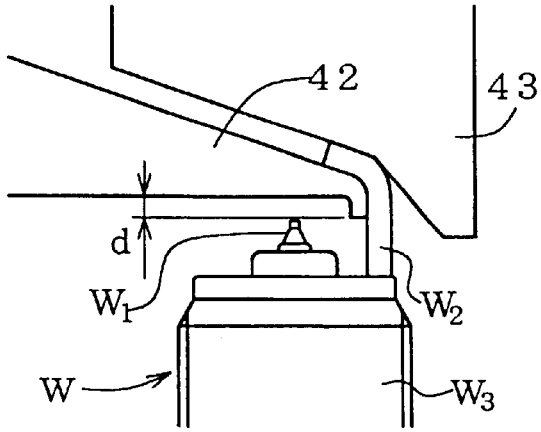

Next, the ground electrode positioning mechanism 12 is adapted to position the ground electrode $W_2$ at a predetermined position by rotating a spark plug by means of an actuator, such as a motor. The tip face position measuring unit 13 is adapted to measure the position of the tip face of the center electrode $W_1$ prior to preliminary bending, which will be described below, and includes a position sensor 115 as shown in FIG. 3(*a*). The workpiece W is held, in a standing condition with the ground electrode $W_2$ facing up, by the holder 23, which is mounted on the linear conveyor 300 to thereby be fixed in height. The position sensor 115 (e.g., a laser displacement sensor) is held at a constant height by a frame used for measuring the height of the tip face and is thus adapted to measure the position of the tip face of the center electrode $W_1$ of a loaded workpiece W.

Referring to FIGS. 3(*b*) and 3(*c*), in operation of the preliminary bending unit 14, a preliminary bending spacer 42 is positioned, on the basis of the position of the tip face of the center electrode $W_1$ of the workpiece W detected by the position sensor 115, such that a substantially constant gap d is formed between the tip face and the bottom of the preliminary bending spacer 42. Then, a free end portion of the ground electrode $W_2$ is pressed against the preliminary bending spacer 42 by use of a bending punch 43 such that the free end portion faces the center electrode $W_1$ via the preliminary bending spacer 42. The bending punch 43 is driven by an unillustrated punch drive unit, such as an air cylinder, in such a manner as to move toward and away from the ground electrode $W_2$ for preliminary bending. While the preliminary bending spacer 42 is positioned such that it is not in contact with the tip face of the center electrode $W_1$; i.e., a predetermined gap d is formed between the preliminary bending spacer 42 and the tip face, the bending punch 43 presses the ground electrode $W_2$ against the preliminary bending spacer 42 to thereby carry out preliminary bending of the ground electrode $W_2$, whereby the electrodes become unlikely to suffer a defect, such as a chip or a scratch, with resultant attainment of high yield.

Figure 4:
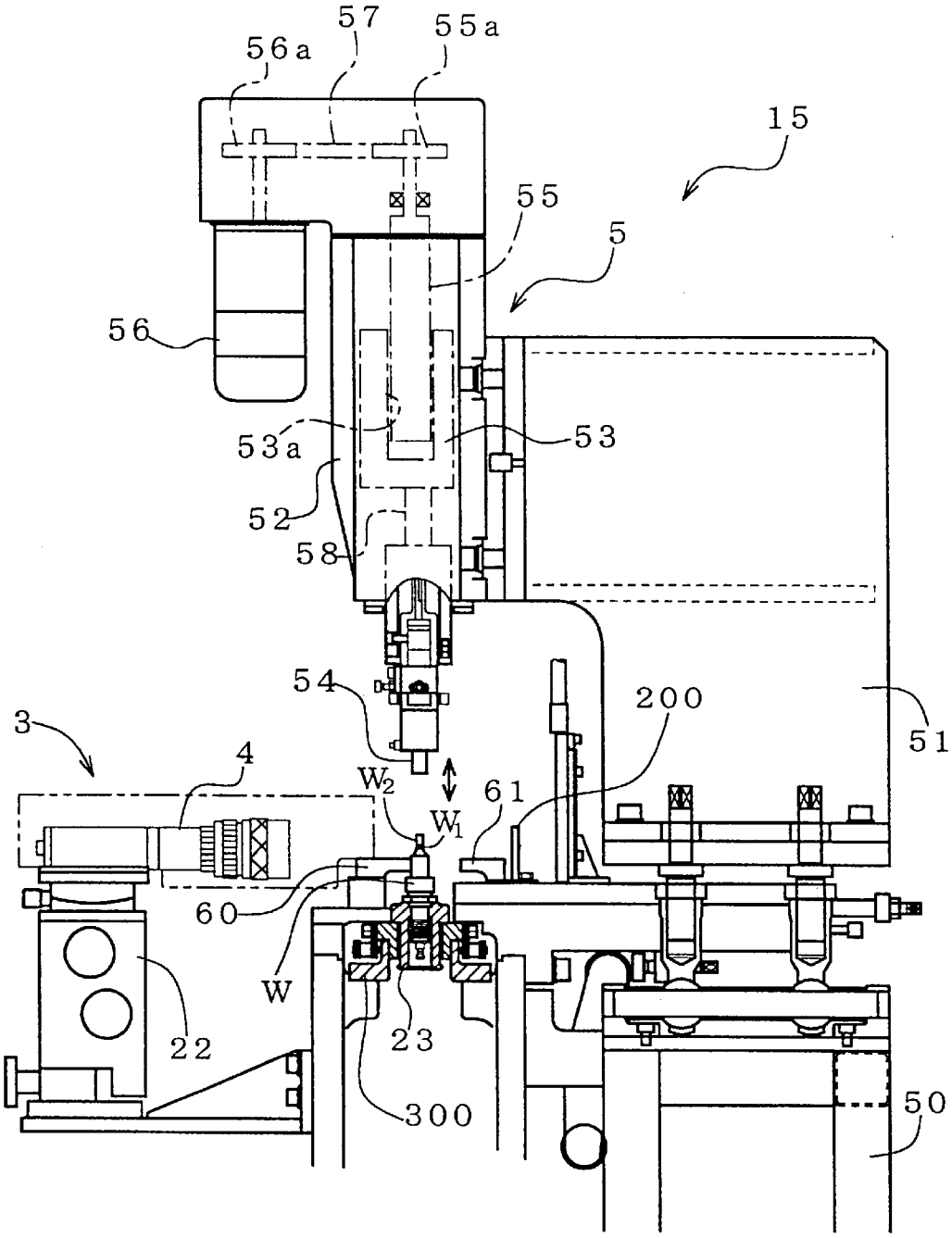
FIG. 4 is a front view showing an example of a main bending unit.

FIG. 4 shows an example of the main bending unit 15. The workpiece W placed in the holder 23 is introduced into the main bending unit 15 by means of the linear conveyor 300 and is then positioned at a predetermined working position. A gap photographing-analyzing unit 3 and a bending mechanism 5, which mainly constitutes gap adjustment means, are disposed on opposite sides of the conveyance path of the linear conveyor 300 such that the unit 3, the mechanism 5, and the working position for the workpiece W are aligned.

Figure 11:
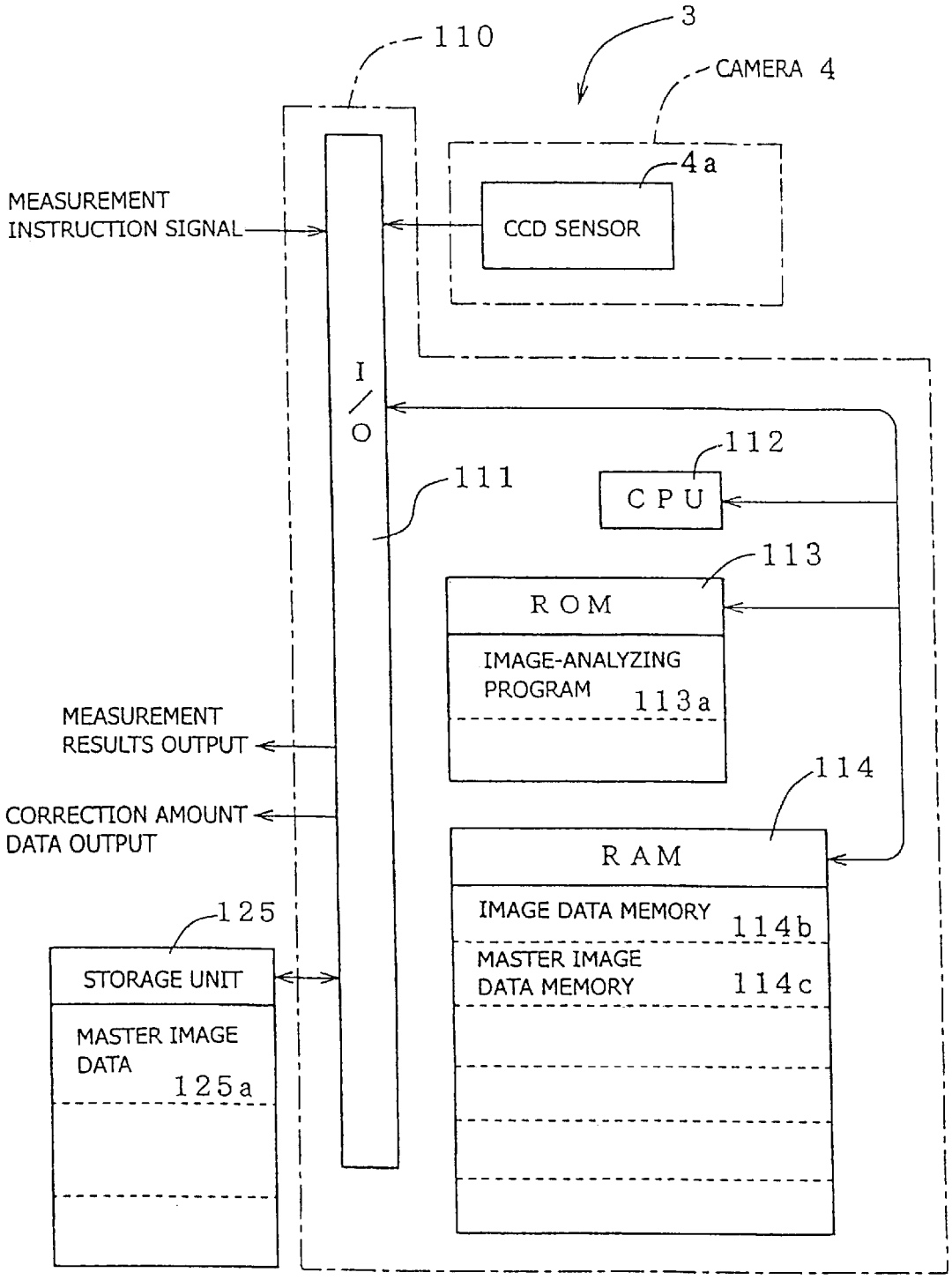
FIG. 11 is a block diagram showing an electrical configuration example of an image analyzer of a photographing-analyzing unit.

The gap photographing-analyzing unit (hereinafter, also called the photographing-analyzing unit) 3 is mainly used for photographing and includes a camera 4, which is supported on a frame 22 and serves as photographing means, and an image analyzer 110 (FIG. 11) connected to the camera 4. As shown in FIG. 11, the image analyzer 110 may comprise a microprocessor which includes an I/O port 111 and components connected to the I/O port 111, such as a CPU 112, a ROM 113, and a RAM 114. The CPU 112 executes an image-analyzing program 113*a* stored in the ROM 113 to thereby implement after-treatment means, gap calculation means, gap correction means, apparent gap size calculation means, electrode edge line determination means, and smoothing means. Referring back to FIG. 4, the camera 4 assumes the form of, for example, a CCD camera which includes a two-dimensional CCD sensor 4*a* (FIG. 11) as an image detector, and is adapted to laterally photograph the center electrode $W_1$ of a workpiece illuminated by an illumination device 200, the ground electrode $W_2$, which faces the center electrode $W_1$, and a spark gap g formed between the center electrode $W_1$ and the ground electrode $W_2$.

The bending mechanism 5 is configured, for example, such that a body casing 52 is attached to the front end face of a cantilever frame 51 mounted on a base 50 of the unit. A movable base 53 is accommodated within the body casing 52 in a vertically movable condition. A press punch 54 is attached to the movable base 53 via a rod 58 in such manner as to project from the bottom end face of the body casing 52. A screw shaft (e.g., a ball screw) 55 is screw-engaged from above with a female screw portion 53*a* of the movable base 53. The screw shaft 55 is rotated in regular and reverse directions by means of a press punch drive motor 56 to thereby move the press punch 54 toward and away from the ground electrode $W_2$ of the workpiece W. Also, by stopping the screw shaft drive, the press punch 54 can be held at any height corresponding to the stop position. The rotating force of the press punch drive motor 56 is transmitted to the screw shaft 55 via a timing pulley 56*a*, a timing belt 57, and a timing pulley 55*a*.

Figure 9:
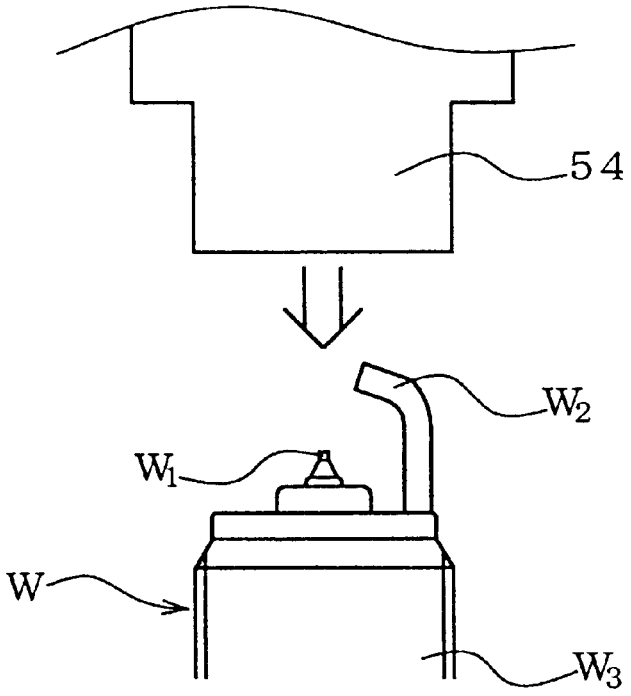
FIGS. 9(*a*) and 9(*b*) are explanatory views showing conceptually an example of a gap adjustment step.
Figure 9:
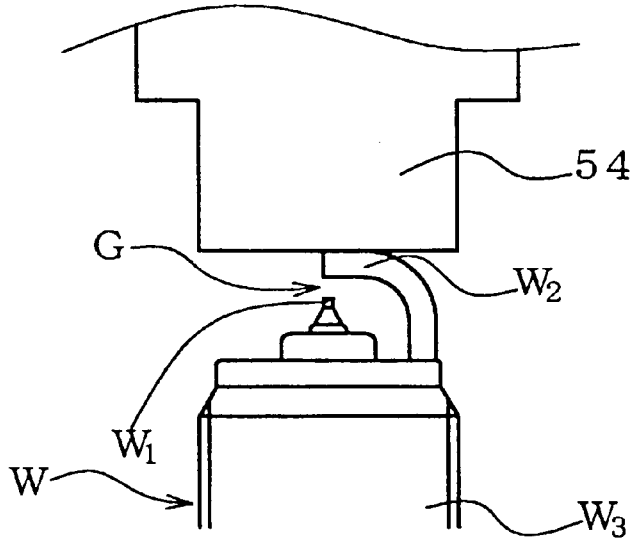

As shown in FIGS. 9(*a*) and 9(*b*), the press punch 54 is caused to approach and press the ground electrode $W_2$ which, for example, is preliminarily bent as shown in FIG. 3(*c*) such that the free end thereof faces obliquely upward, thereby performing main bending work, which is a major work of a gap adjustment step, such that a free end portion of the ground electrode $W_2$ becomes substantially parallel to the tip face of the center electrode $W_1$ Thus, the spark discharge gap is adjusted to a target value. As shown in FIG. 4, while main bending work is performed, the workpiece W is fixedly held, from opposite sides with respect to the axial direction, between holder members 60 and 61. The main bending work utilizes image information obtained from a photographing step.

Figure 5:
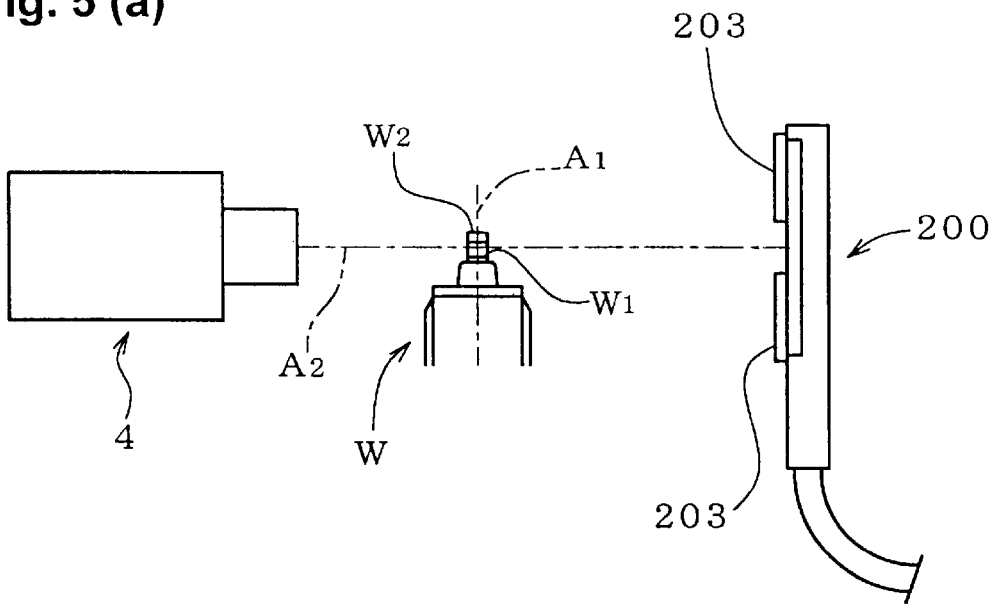
FIGS. 5(*a*) and 5(*b*) are explanatory views showing conceptually an example of a photographing step.
Figure 5:
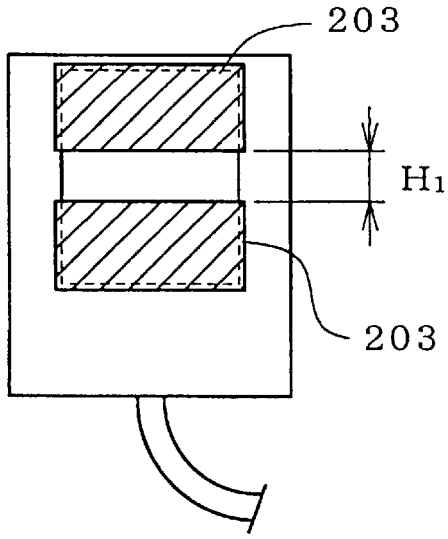
Figure 6:
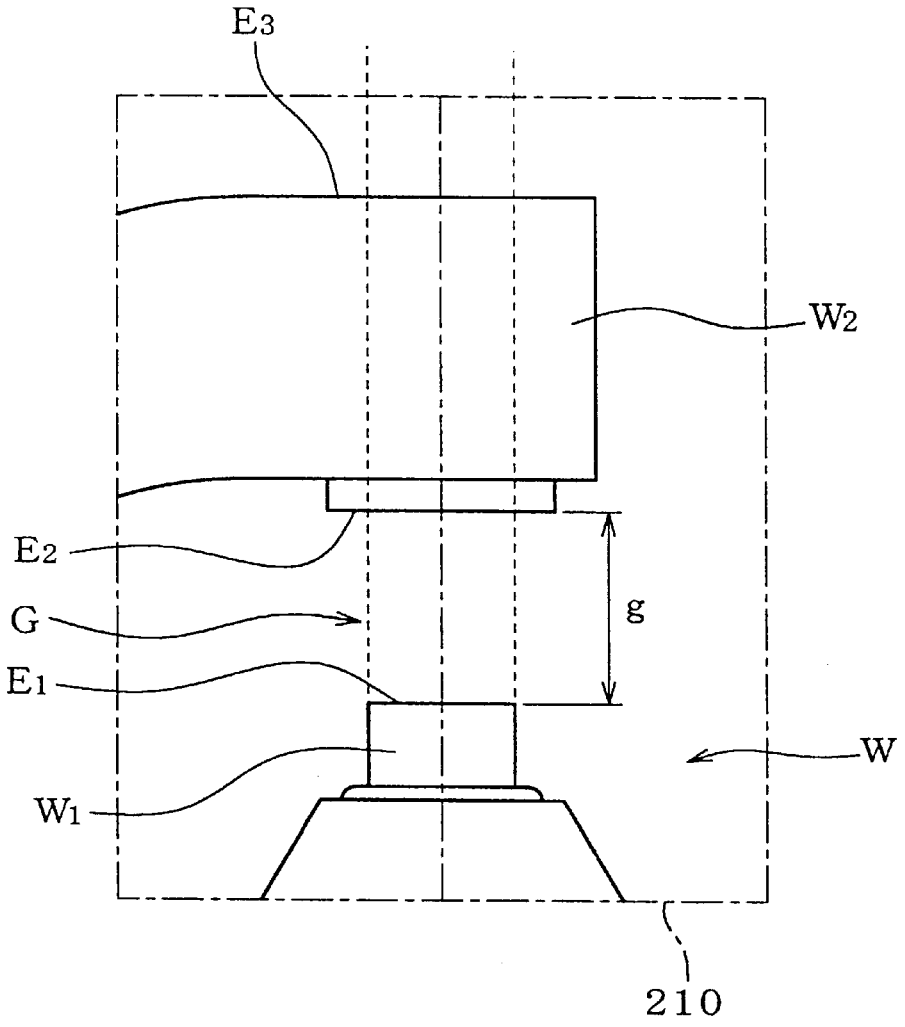
FIG. 6 is a view showing an example of an image obtained through photographing.

Next, the photographing step for obtaining image information to be used in main bending work (a gap adjustment step) will be described in detail. As shown in FIG. 5(*a*), in order to perform the photographing step, the illumination device 200 is disposed in opposition to a tip portion of the workpiece W (spark plug), in which a spark gap is to be formed, such that illumination rays pass through the spark gap. The embodiment of FIG. 5 uses a planar-light-emission-type illumination device. Light shields 203 are provided for the illumination device 200 in order to limit the range of emission from the illumination device 200 to a predetermined range. The light shields limit the emission range of illumination rays directed to the camera 4 via a spark plug to a predetermined range ($H_1$) as measured along the axial direction of a center electrode. The photographing direction of the camera 4 is a direction $A_2$ substantially perpendicular to the axial direction $A_1$ of the center electrode. The camera 4, which is disposed in opposition to the illumination device 200 with respect to a tip portion of the spark plug, photographs a spark gap formed between the center electrode $W_1$ and the ground electrode $W_2$. As shown in FIG. 6, the camera 4 photographs the spark gap g of the workpiece W at predetermined magnifications such that the image includes the entire tip edge $E_1$ of the center electrode $W_1$ facing the spark gap g as well as a portion of tip edge $E_2$ of the tip face of the ground electrode $W_2$ facing the spark gap g, and the edge $E_3$ of the ground electrode $W_2$ facing away from the spark gap g.

Figure 10:
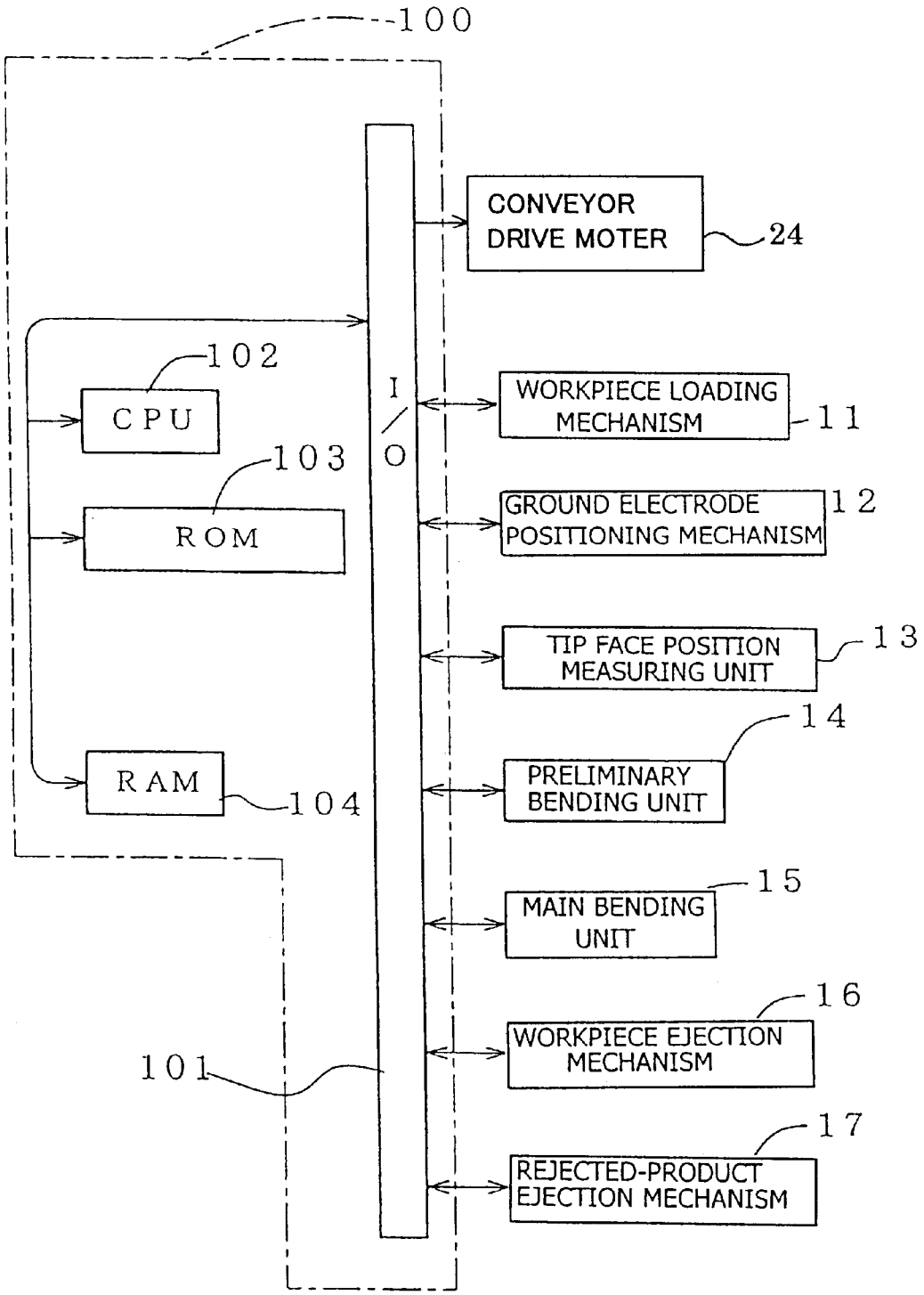
FIG. 10 is a block diagram showing an electrical configuration example of an apparatus for manufacturing a spark plug of the present invention.
Figure 12:
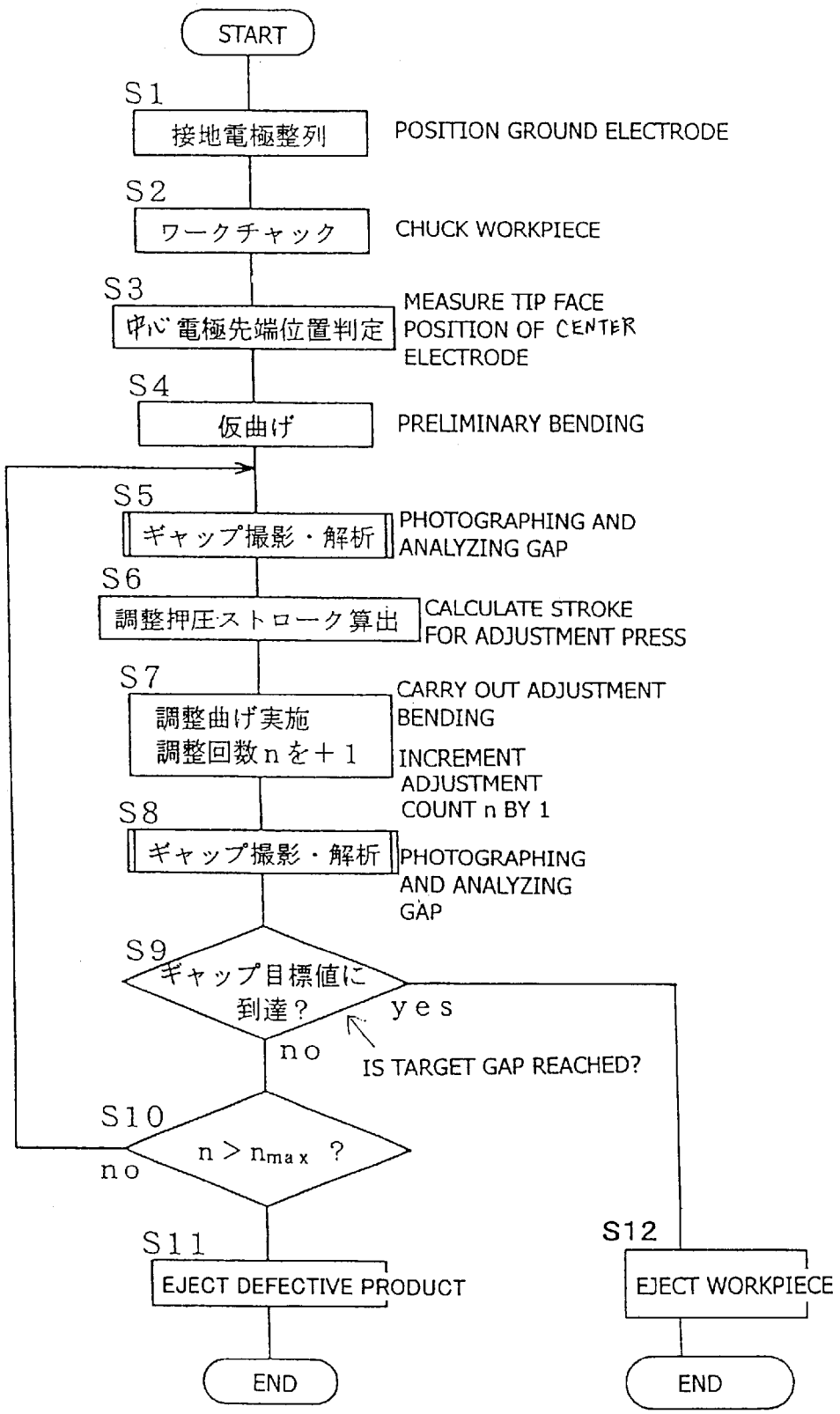
FIG. 12 is a flowchart showing a major processing flow of the manufacturing apparatus of FIG. 1.

The flow of major processing in the method of the present invention for manufacturing a spark plug by use of the manufacturing apparatus 1 will next be described with reference to the flowchart of FIG. 12. In order to carry out the processing, the manufacturing apparatus 1 is configured such that, as shown in FIG. 10, a main controller 100 includes a CPU 102, a ROM 103, and a RAM 104 and is connected to relevant mechanisms and units via an I/O port 101.

The processing flow will be described below. Upon completion of a ground electrode positioning step (S1), the carrier 302 is moved to a workpiece loading position, where the workpiece W is loaded onto a workpiece holder, and the holder chucks the workpiece W (S2). Subsequently, at S3, the workpiece W is conveyed to the position of the tip face position measuring unit 13 by means of the linear conveyor 300. As shown in FIG. 3, the tip face position measuring unit 13 measures the tip face position. Then, at S4, preliminary bending described previously is carried out as shown in FIGS. 3(*b*) and 3(*c*).

At S5, a gap photographing-analyzing process is performed. The workpiece W is moved to and positioned at a photographing position of the photographing-analyzing unit 3. The image analyzer 110 (FIG. 11) retrieves an image from the camera 4 and analyzes the image to thereby obtain the value of the spark gap g (which will be described below in detail). Next, at S6, the image analyzer 110 reads a target value of the spark gap g (stored in, for example, the ROM 103 (FIG. 10)) and compares the target value with a measured value of the spark gap g, thereby calculating a stroke along which the press punch 54 of the main bending unit 15 (FIG. 4) is moved for adjustment press.

At S7, the workpiece W is moved to and positioned at the bending work position of the main bending unit 15 of FIG. 4. The main bending unit 15 receives an instruction and the value of stroke for the adjustment press from the main controller 100 and causes the motor 56 to operate so as to press the ground electrode $W_2$, thereby adjusting the gap through bending work. At this time, the main controller 100 increments bending count n stored in the RAM 104 (FIG. 10).

Next, at S8, the workpiece W is again moved to the photographing position, where the gap is again measured. At S9, the measured gap is compared with the target value and a judgment is made as to whether or not the target value is attained. When the measured gap fails to reach the target value, control returns to S6 via S10, and bending and gap measurement are similarly repeated. If the target value is still not attained at a bending count n in excess of an upper limit $n_{max}$ as observed at S10, the workpiece W is judged defective. Processing is brought to an end, and control proceeds to S11 for ejection of the workpiece W as a defective product. By contrast, when the measured gap is found at S9 to have reached the target value, the workpiece W is judged non-defective. In this case, control proceeds to S12 for ejection of the workpiece W, and then ends the processing.

Figure 13:
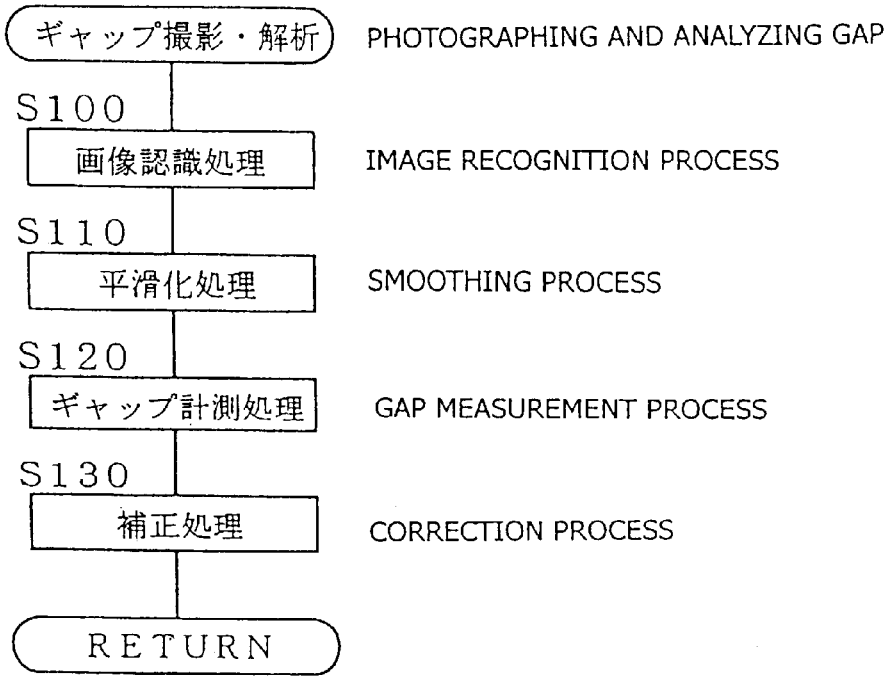
FIG. 13 is a flowchart showing an example flow of a gap photographing-analyzing process.

Next, the gap photographing-analyzing process will be described. As shown in FIG. 13, the gap photographing-analyzing process (S5 and S8) in FIG. 12 is composed roughly of an image recognition process (S100), a smoothing process (S10), a gap measurement process (S120), and a correction process (S130). In execution of the image recognition process, the CPU retrieves image data regarding the center electrode $W_1$ or the ground electrode $W_2$ (generically called "workpiece image data" in the drawings), reads master image data 125*a* corresponding to the image data from a storage unit 125 (FIG. 11), and stores the data in the memories 114*b* and 114*c*, respectively, of the RAM 114.

A master image is created by photographing, under predetermined conditions, portions of the center electrode $W_1$ and the ground electrode $W_2$ which face each other with the gap g provided therebetween, with respect to a standard product of a spark plug of a certain product number to be inspected. On the basis of the master image and an image obtained by photographing, edge line information is created that specifies electrode edge lines of the center electrode $W_1$ and the ground electrode $W_2$, thereby determining coordinates of points which define the electrode edge lines on the captured image. The edge line information can be created, for example, by the method disclosed in Japanese Patent Application Laid-Open (kokai) No. 2000-180310. The thus-created edge line information is stored in the RAM 114 of the image analyzer 110.

Figure 14:
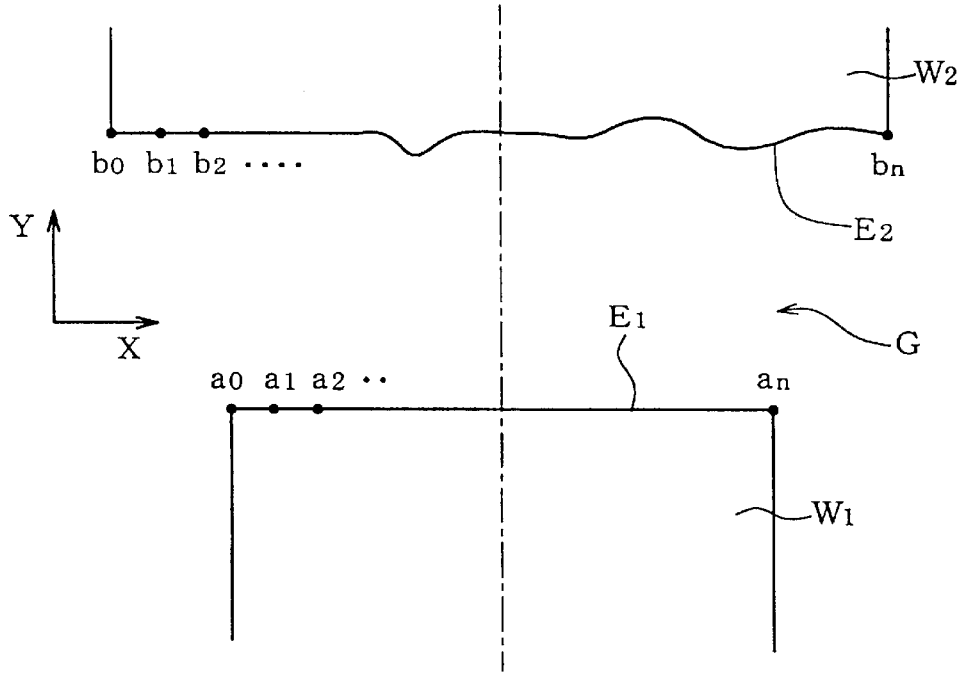
FIGS. 14(*a*) and 14(*b*) are explanatory views showing an example in which the edge profile of a ground electrode is represented on an X-Y plane.
Figure 14:
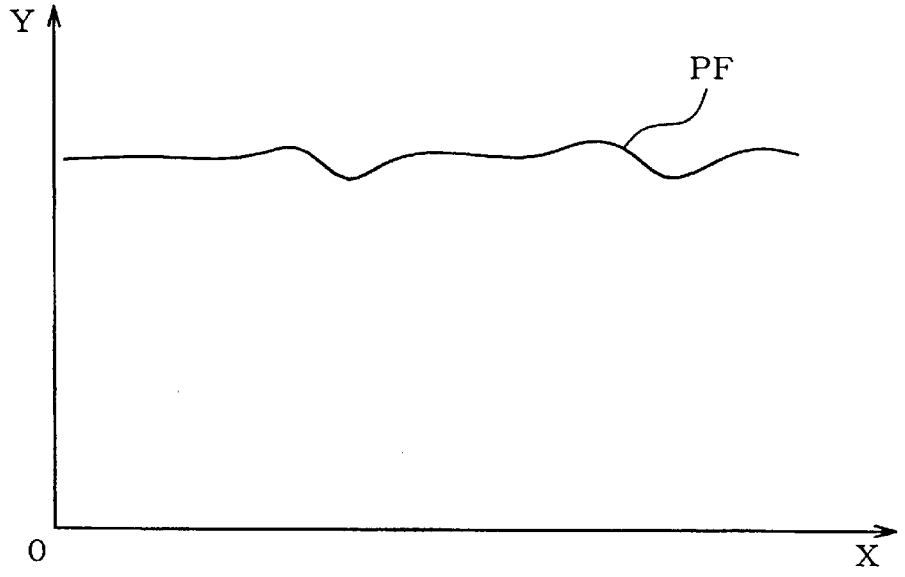

Next, the smoothing process (S110 in FIG. 13) will be described. First, the CPU reads information about the tip edge line $E_2$ of the ground electrode W2 (the information is a set of positional coordinates of points (pixels) on the edge line) obtained from a captured image. FIG. 14(*a*) shows an example of a captured image in which a portion of or all of component pixels of an edge line are outline measurement points (center electrode: $a_0, a_1, a_2, \ldots, a_m$; ground electrode: $b_0, b_1, b_2, \ldots, b_n$), which will be described below. As shown in FIG. 14(*b*), plotting a set of positional coordinates on the X-Y plane represents an undulation level profile PF of the tip edge line $E_2$ of the ground electrode $W_2$.

The undulation level profile PF is subjected to a smoothing process. Various methods are available for smoothing. Examples of smoothing methods include a method in which a moving average is obtained on the basis of the above-mentioned undulation level profile and a method in which the above-mentioned undulation level profile is functionally approximated by use of the least squares method. Specifically, on an X-Y coordinate system, an undulation level profile is approximated by use of a moving average obtained from a plurality of neighbor points on an edge line which partially constitute the undulation level profile, to thereby be smoothed. Alternatively, on the coordinate system, the undulation level profile is functionally approximated by use of the least squares method to thereby smoothen the same.

Figure 15:
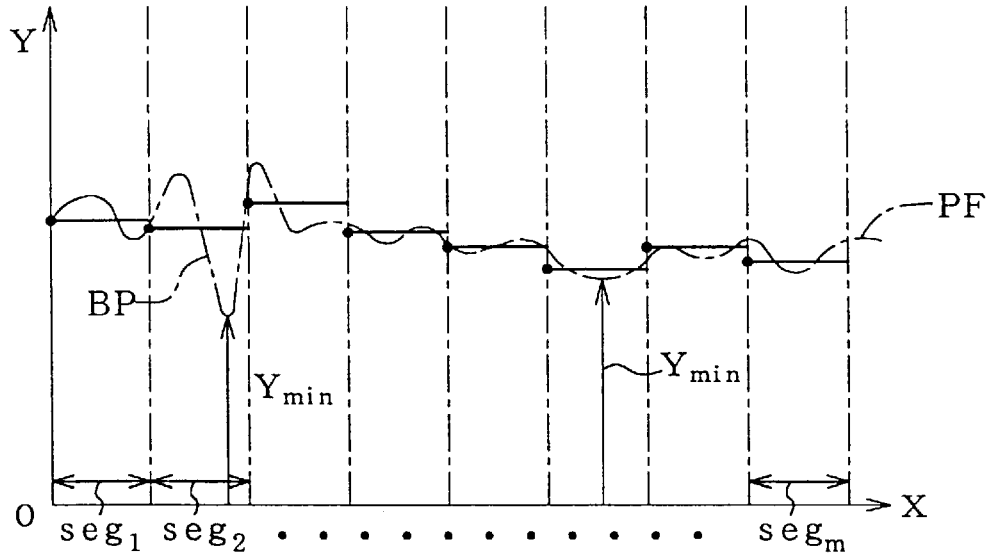
FIG. 15 is a view showing the concept of a smoothing process example.

Also, the following method may be used. As shown in FIG. 15, the undulation level profile PF is divided into a plurality of segments $Seg_1$, $Seg_2$, . . . , $Seg_m$, each of which has a predetermined length. The undulation level profile PF is subjected to a leveling process for each segment. For example, in FIG. 15, a salience BP sharply projecting downward, which is conceivably caused by a burr or the like formed in the course of blanking, appears as minimum level (Ymin) in segment $Seg_2$. The leveling process levels off the profile in the segment to thereby reduce the height of the salience BP; thus, the influence of the salience BP on gap measurement, which will be described below, decreases. The segment width is determined as appropriate according to the size of the salience BP; for example, in such a manner as not to be less than the width of the salience BP. In this leveling process, the undulation level profile PF is divided into as many segments as the number of component data points, which is c. The total sum SR of undulation levels (i.e., Y values) in each segment is calculated. The obtained total sum SR is divided by c to thereby yield an average value $Y_m$ for each segment. The Y data of each segment are replaced with the $Y_m$ value of the corresponding segment.

Figure 16:
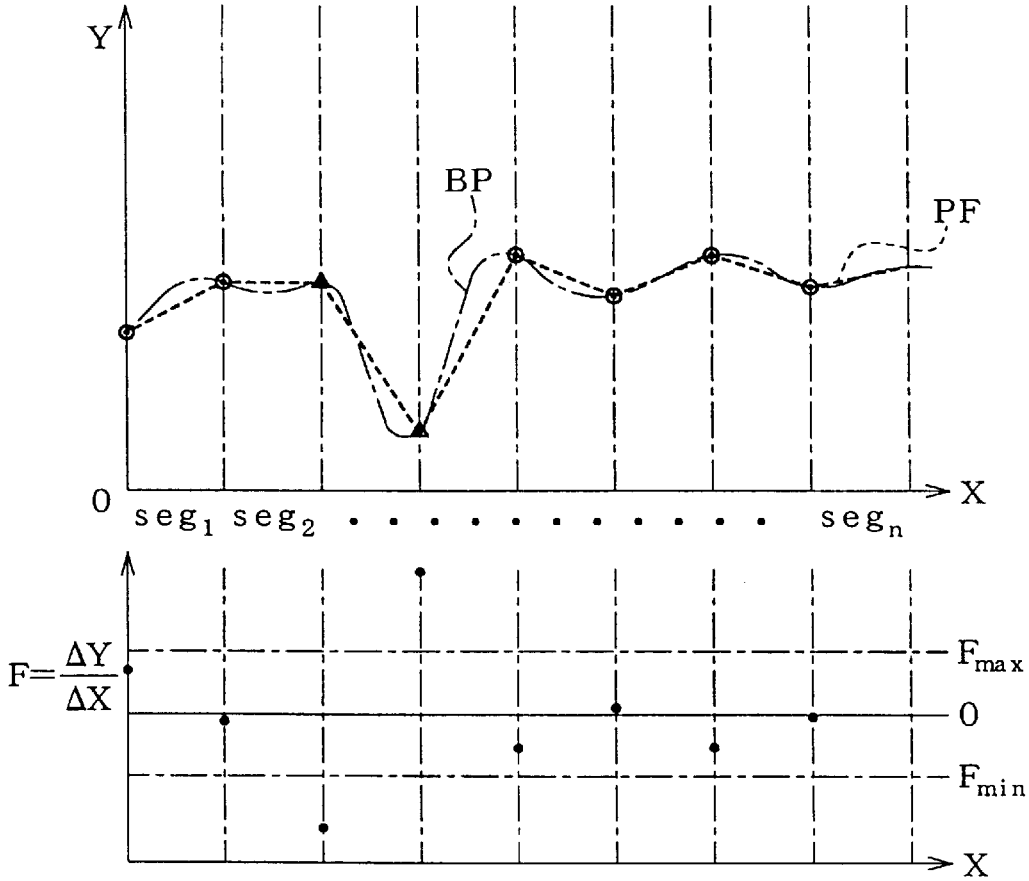
FIG. 16 is a view showing the concept of another smoothing process example.

Alternatively, as shown in FIG. 16, the undulation level profile PF is divided into a plurality of segments $Seg_1$, $Seg_2$, . . . , $Seg_1$, each of which has a predetermined length. The rate of change in undulation level F ($=\Delta Y/\Delta X$) is calculated for each segment. When the rate of change F of a certain segment fails to meet a predetermined requirement; for example, when the rate of change F falls outside a predetermined range (e.g., outside a range of lower limit Fmin to upper limit Fmax), the undulation level of an edge line of the segment is modified. In this case, a modification process is performed so as to decrease the influence of a fine salience BP appearing in a segment (in the figure, salience BP is present while extending between $Seg_3$ and $Seg_4$); for example, the undulation level in the segment is subjected to leveling, or the value of undulation level is modified such that the salience height decreases.

A modification process example is described in which the undulation level of a certain segment which fails to meet a requirement is replaced with the average undulation level of the entire profile PF. In this example, the profile PF is divided into a plurality of minimum segments each having the span between a data point in question and the next data point. First, the average value $Y_m$ of Y values is calculated. Assuming that the data point in question is the i'th data point, the difference in Y value between the data point in question and the next data point (i.e., the (i+1)'th data point) is obtained; i.e., $\Delta Y$ ($=Y_{i+1}-Y_i$) is obtained. The difference $\Delta Y$ is divided by the distance $\Delta X$ between the neighbor data points, thereby yielding the rate of change F ($=\Delta Y/\Delta X$). As shown in FIG. 16, when the rate of change F falls outside the range of the lower limit value Fmin to the upper limit value Fmax, the $Y_i$ value is replaced with the average value $Y_m$ (i.e., the $Y_i$ value is modified). This modification is carried out with all values of the i parameter.

Figure 17:
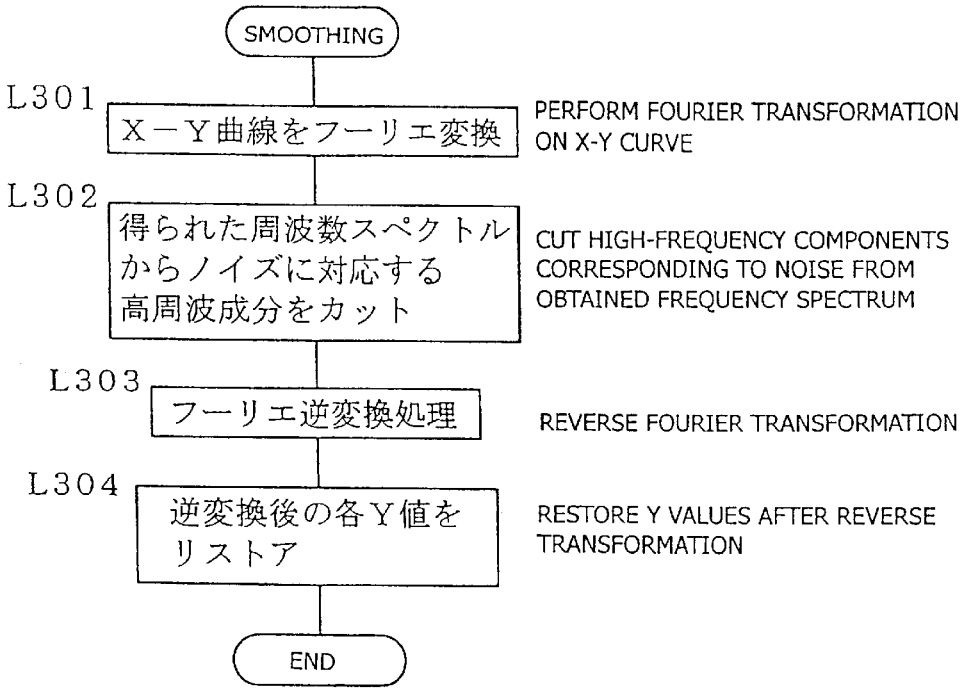
FIG. 17 is a flowchart showing a smoothing process example in which an undulation profile is smoothed by use of low-pass filter processing.
Figure 18:
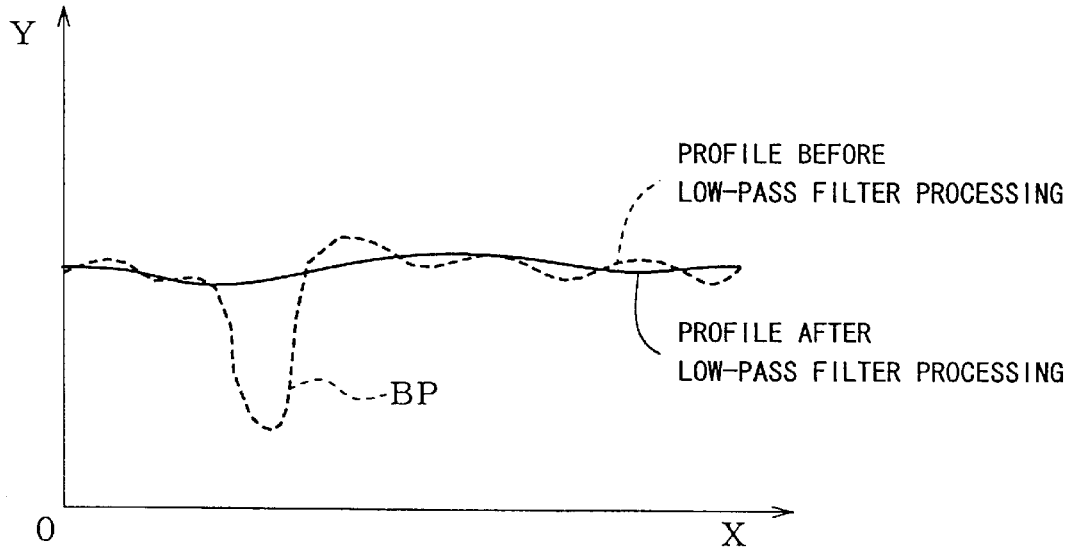
FIG. 18 is an explanatory view showing the concept of the smoothing process of FIG. 17.

Further, the smoothing process may use a method in which high-frequency components are removed from the above-mentioned undulation level profile by use of Fourier analysis. Specifically, as shown in FIG. 18, while being considered as a waveform curve, the profile PF can be subjected to low-pass filter processing. Various known methods are available for low-pass filter processing. For example, as shown in FIG. 17, the profile PF (an X-Y curve) is subjected to Fourier transformation in the X-Y coordinate system, thereby obtaining the frequency spectrum of the profile PF (L301). In FIG. 17, the salient BP can be considered as a high-frequency noise component not less than a certain frequency. In L302 of FIG. 17, high-frequency components not less than a cutoff frequency that is determined as appropriate according to salient width are cut from the obtained frequency spectrum. In L303, the resultant frequency spectrum is subjected to reverse Fourier transformation. As a result, as shown in FIG. 18, a filter-processed profile is obtained (as represented by the solid line) resulting from high-frequency components being cut from the original profile (as represented by the dashed line); in other words, the influence of the salient BP is decreased. In addition to the above-described method for carrying out low-pass filter processing by software means, a hardware method is available; for example, a digital output of X-Y data is caused to pass through an analog low-pass filter circuit or a digital low-pass filter circuit by utilizing a D/A converter and an A/D converter before the data is received.

Figure 7:
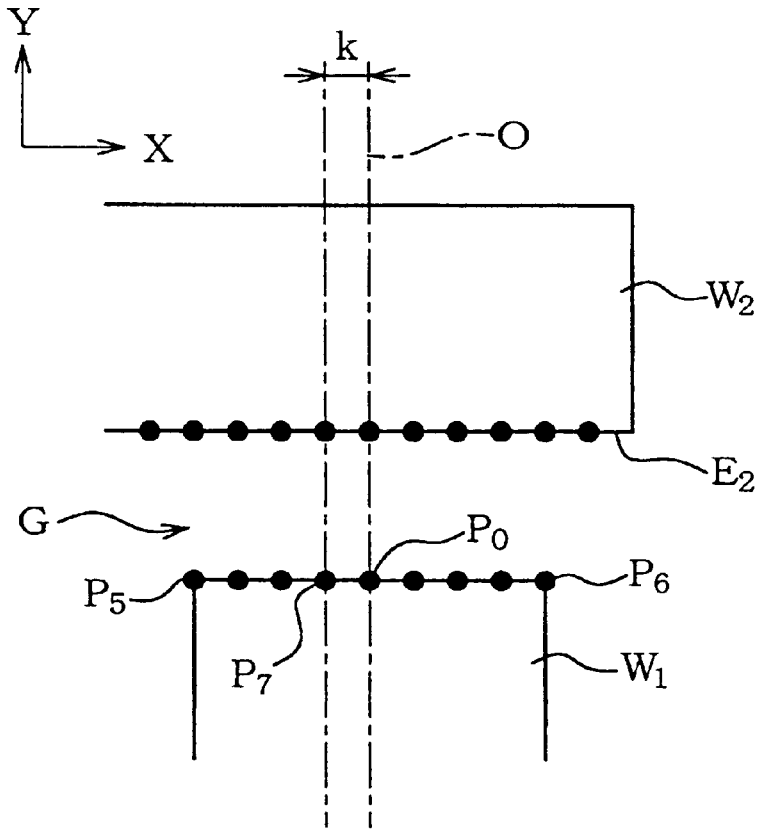
FIGS. 7(*a*) and 7(*b*) are explanatory views showing an example method for measuring a gap size.
Figure 7:
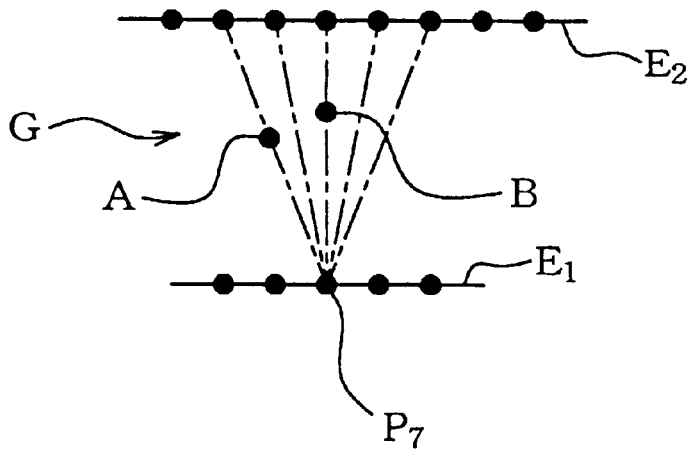

Next, an example of the gap measurement process (S120 in FIG. 13) will be described. The CPU reads information about the tip edge line $E_2$ of the ground electrode $W_2$ which has been smoothed by the above-described smoothing process as well as information about the tip edge line $E_1$ of the center electrode $W_1$ which has been similarly smoothed. As shown in FIG. 7(*a*), a plurality of measurement points are determined on the outline of a ground electrode spark gap definition portion of the ground electrode $W_2$ facing a spark gap G and on the outline of a center electrode spark gap definition portion of the center electrode $W_1$. The measurement points represent the outlines of the respective spark gap definition portions. In FIG. 14, the measurement points on the outline on the center electrode side are represented by $a_0$, $a_1$, $a_2$, . . . , $a_m$, whereas the measurement points on the outline on the ground electrode side are represented by $b_0$, $b_1$, $b_2$, . . . , $b_n$. Notably, the ground electrode spark gap definition portion as used herein refers to a portion of the ground electrode $W_2$ which faces the center electrode $W_1$ across the spark gap G and whose outline is the tip edge line $E_2$. In the case of a ground electrode having a chip as shown in FIG. 6, the face of the chip which faces the spark gap G serves as the ground electrode spark gap definition portion. In the case of a ground electrode whose side surface directly faces a center electrode, a portion of the side surface of the ground electrode which faces the center electrode serves as the ground electrode spark gap definition portion. The center electrode spark gap definition portion refers to a portion of the center electrode $W_1$ which faces the ground electrode $W_2$ (specifically, the ground electrode spark gap definition portion) across the spark gap G and whose outline is the tip edge line $E_1$ (the tip face of a center electrode).

Measurement points on each outline may be selected at intervals of predetermined pixels on the corresponding edge line, or all pixels on the edge line may serve as measurement points on the corresponding outline. A single measurement point on the outline of one spark gap definition portion is selected as a reference point. A measurement point on the outline of the other spark gap definition portion is found such that the distance between the measurement point and the reference point is the shortest. On the basis of the shortest distance, a gap is determined. In FIG. 7(*b*), a single measurement point on the center electrode side is selected as a reference point. As represented by the dash-and-dot lines A, the distance between the reference point and all measurement points ($b_0$, $b_1$, $b_2$, . . . , $b_n$) on the ground electrode side is calculated. Among the thus-obtained distances, the shortest distance (represented by the dash-and-dot line B) is selected. Further, a plurality of measurement points a are selected as reference points, and the shortest distance between each of the reference points and a measurement point on the outline of the other spark gap definition portion is obtained. Specifically, all measurement points on the outline of one electrode serve as reference points, and the distance to measurement points on the outline of the other electrode can be obtained with all of the reference points. On the basis of the minimal value among a plurality of thus-obtained shortest distances, a gap is determined. Thus, even when a workpiece is inclined within an X-Y plane in an image coordinate system, a gap can be calculated irrespective of the inclination. That is, even when a workpiece is inclined within a plane which is parallel to the center axis and is perpendicular to the width direction of a ground electrode, error-free measurement can be carried out. In the present embodiment, the thus-obtained apparent gap size (apparent gap size g') appearing on an image is corrected. The reference point $P_7$ is used to measure the apparent gap size g'.

Next, the correction process (S130 in FIG. 13) will be described. The correction process is adapted to correct a gap for inclination along the direction of photographing by photographing means (the camera 4) (specifically inclination within a plane which is in parallel to the width direction of the ground electrode $W_2$ and is in parallel to the axial direction of the center electrode). Specifically, the apparent gap size g' is corrected on the basis of an apparent dimension of a predetermined measurement reference portion of a spark plug (a measurement reference portion apparent-dimension) as observed on a captured image and a known standard dimension of the measurement reference portion (a measurement reference portion standard-dimension). In this correction, a dimensional error in the apparent gap size associated with photographing with the axis of the center electrode being inclined (specifically, a dimensional error associated with the spark plug being photographed while being inclined along the direction of photographing by the photographing means (the camera 4)) is corrected on the basis of the measurement reference portion apparent-dimension and the measurement reference portion standard-dimension.

Figure 8:
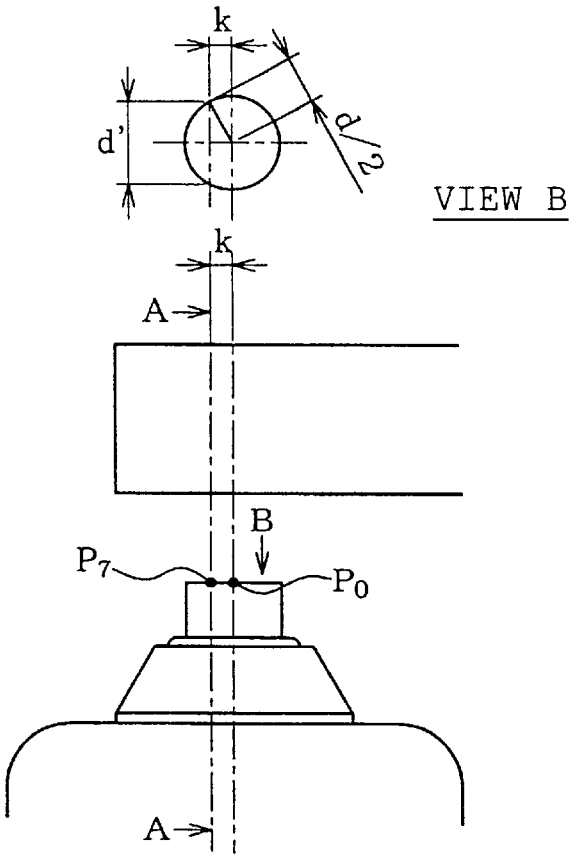
FIGS. 8(*a*) and 8(*b*) are explanatory views showing an example correction method.
Figure 8:
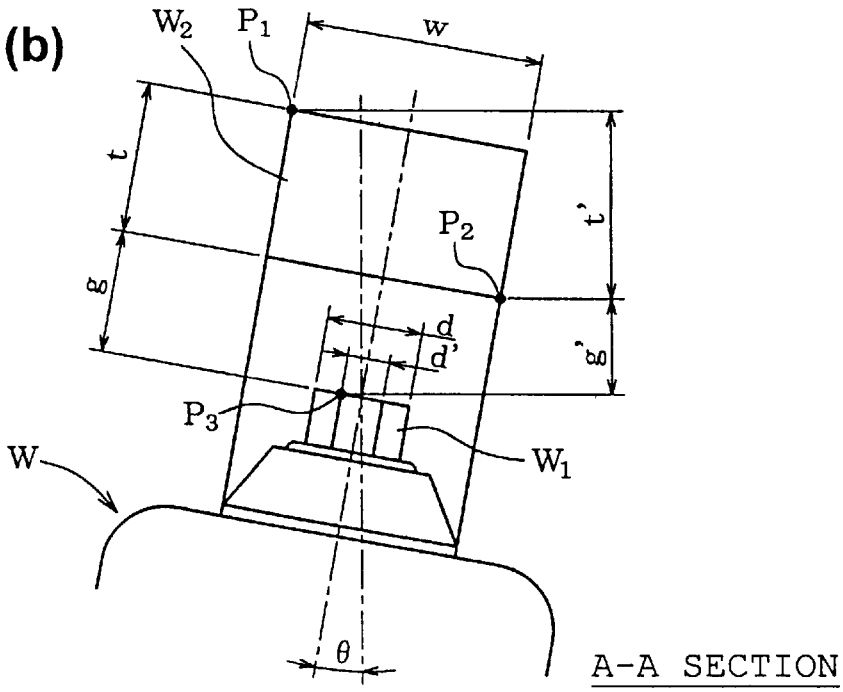

The present embodiment employs the ground electrode $W_2$ as a measurement reference portion and employs a known standard thickness t of the ground electrode (hereinafter also called a ground electrode standard-thickness t) as a measurement reference portion standard-dimension. The thickness t' of the ground electrode as observed on an image obtained through photographing (hereinafter also called a ground electrode apparent-thickness t') is obtained as a measurement reference portion apparent-dimension. The apparent gap size g' is corrected on the basis of the ground electrode apparent-thickness t', the ground electrode standard-thickness t, and a predetermined, known standard width w of the ground electrode. Further, the present embodiment uses a known diameter d of a center electrode as a correction parameter in addition to t, t' and w to thereby correct the apparent gap size g' on the basis of at least these four parameters. Known dimensions (t, w, d, etc.) to be predetermined may be obtained beforehand through measurement of actual dimensions of a reference product by use of length measurement means such a micrometer. Next, a specific correction expression will be described. In order to obtain a correction expression, the following expressions may be employed on the basis of geometric relations as shown in FIG. 8. In FIG. 8, the spark plug is photographed such that the axis of the center electrode is inclined by angle θ along the direction of photographing, and g is a gap size to be obtained. Photographing means carries out photographing in the direction of arrow A. On an image obtained through photographing, edges represented by points $P_1$ and $P_2$ appear as edges of the ground electrode, and an edge represented by point $P_3$ appears as an edge of the center electrode (specifically, as an edge serving as the reference point $P_7$ (see FIG. 7) used for measuring the apparent gap size g').

Expression 1:

$$t'=t\times\cos\theta+w\times\sin\theta$$

$$g'=g\times\cos\theta-d'\times\sin\theta-0.5\times(w-d')\times\sin\theta$$

$$d'=\sqrt{d^2-4\times k^2}$$

The above expressions are simultaneously solved for g, thereby yielding the following expression which serves as a correction expression.

Expression 2:

$$g=\frac{g'}{\cos\theta}+\frac{\tan\theta}{2}(w+d')$$

where $$\theta=\cos^{-1}\left(\frac{t\times t'+w\times\sqrt{w^2+t^2-t'^2}}{w^2+t^2}\right)$$

$$d'=\sqrt{d^2-4\times k^2}$$

The present embodiment employs, as a parameter, distance k of the measurement position of the apparent gap size g' as measured from the axis O of the center electrode $W_1$, in addition to the above-mentioned parameters. Specifically, for example, as shown in FIG. 7, the center point $P_0$ between the opposite end points $P_5$ and $P_6$ is determined on the outline of the spark gap definition portion of the center electrode. The distance between the center point $P_0$ and the reference point $P_7$, which is used for measuring the apparent gap size g', can be k. Dimension d' refers to the distance between opposite ends of the center electrode spark gap definition portion as measured on the outline of the portion on the section of the spark plug which is taken in parallel to the axis O of the center electrode $W_1$ and the width direction of the ground electrode $W_2$ at a position located radial distance k away from the axis O. Dimension d' is determined on the basis of distance k and the known diameter d of the center electrode by use of the above-mentioned expression. When the center electrode diameter is small or when the tip face of the center electrode is not flat, the diameter d of the center electrode can be considered as 0. Thus, correction may be made assuming that dimension d' as measured at a position located distance k away from the axis of the center electrode is O. For example, a value d' of 0 may be substituted into the above-mentioned correction expression to thereby obtain a correction value. A corrected value g, which is obtained by correcting the apparent gap size g', is employed as a gap size. On the basis of the gap size g, a gap adjustment step, which is an example of an after-treatment step, is carried out so as to adjust the gap size of the spark gap G. The gap adjustment step is performed using the main bending unit 15 in the following manner. As shown in FIG. 9(*b*), the press punch 54 which, as shown in FIG. 9(*a*), is caused by an unillustrated drive unit, such as a screw shaft mechanism, to vertically move toward and away from the ground electrode $W_2$ of the workpiece W positioned within the main bending unit 15, performs main bending work on the ground electrode $W_2$, which is preliminarily bent such that the free end thereof faces obliquely upward, such that a free end portion of the ground electrode $W_2$ becomes substantially parallel to the tip face of the center electrode $W_1$.

The main bending work is carried out while the spark gap is being monitored with the camera 4. On the basis of image information (gap size g) obtained from the photographing step, the spark discharge gap is adjusted to a predetermined value. The press punch 54 is provided with a load cell at its tip. Upon detection of contact with an outside electrode, the press punch 54 performs bending work by an amount of displacement as instructed by an image unit, which performs dimensional measurement and the like. Notably, various specific methods are available for adjusting the spark gap on the basis of image information obtained from the photographing step. For example, a method for adjusting the spark gap in a stepwise manner as disclosed in Japanese Patent Application Laid-Open (kokai) No. 2000-164322 may be employed.

The after-treatment step is not limited to the gap adjustment step. For example, a defect control step for controlling defects on the basis of the obtained gap size g may be employed. The defect control step may be implemented as a defective-product rejection step in which a product whose gap size g obtained fails to conform to the criteria for a conforming product is rejected as a non-conforming product. In this case, since a non-conforming product is rejected after the edge condition is definitely judged, an error in discriminating between conforming and non-conforming products with respect to shape is greatly reduced. Also, a product data generation step may be employed in which product data regarding a photographed product are generated on the basis of the gap size g. The product data generation step may employ the following method. For example, when a photographed product is judged defective on the basis of the gap size g, information about a defect in the photographed product (information about whether or not defect is present, information about the type of defect, etc.) and basic product information regarding the photographed product (product No., date of inspection, lot No., etc.) are stored in a database in a correlated condition. Thus, statistical control can be performed while conforming and non-conforming products are discriminated from each other at high accuracy.

The above-described embodiment employs a method in which edge line information which specifies edge lines of the center electrode $W_1$ and the ground electrode $W_2$ is generated from a photographed image, and a reference point is defined on the edge lines in order to measure a gap size. The step of defining a reference point on the edge lines enables direct obtainment of the shortest distance across the gap with high accuracy. However, the reference point is not necessarily required to be defined on the edge lines. Further, the gap size may be measured without generation of edge line information. A specific method of measuring gap size without generation of edge line information will be described below.

As in the above-described embodiment, a spark gap formed between the center electrode $W_1$ and the ground electrode $W_2$ of a spark plug is photographed using camera 4, which is disposed in opposition to the illumination device 200 with respect to a tip portion of the spark plug. As shown in FIG. 6, the camera 4 photographs the spark gap g of the workpiece W at predetermined magnifications such that the image includes the entire tip edge $E_1$ of the center electrode $W_1$ facing the spark gap g as well as a portion of tip edge $E_2$ of the tip face of the ground electrode $W_2$ facing the spark gap g, and the edge $E_3$ of the ground electrode $W_2$ facing away from the spark gap g. Notably, the image photographed by the camera 4 is a gray-scale image composed of a plurality of pixels each of which can have an intermediate density. The gray-scale image of the center electrode $W_1$ and the ground electrode $W_2$ facing each other via the spark gap is digitized to binary data using a predetermined density threshold such that the center electrode $W_1$ and the ground electrode $W_2$ are represented by black or dark areas, and the space is represented by a white or light area.

Figure 19:
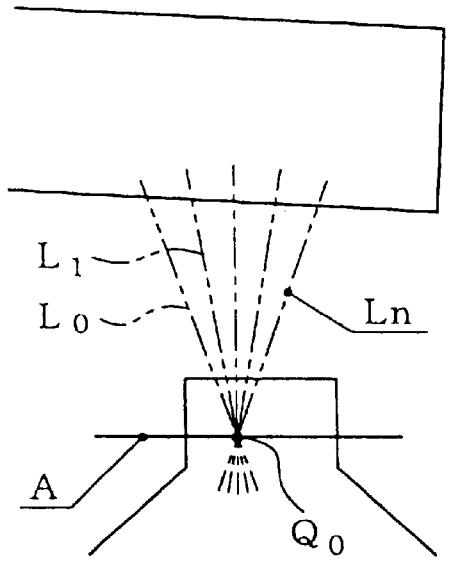
FIGS. 19(*a*), 19(*b*) and 19(*c*) are explanatory views showing another method for measuring gap size.
Figure 19:
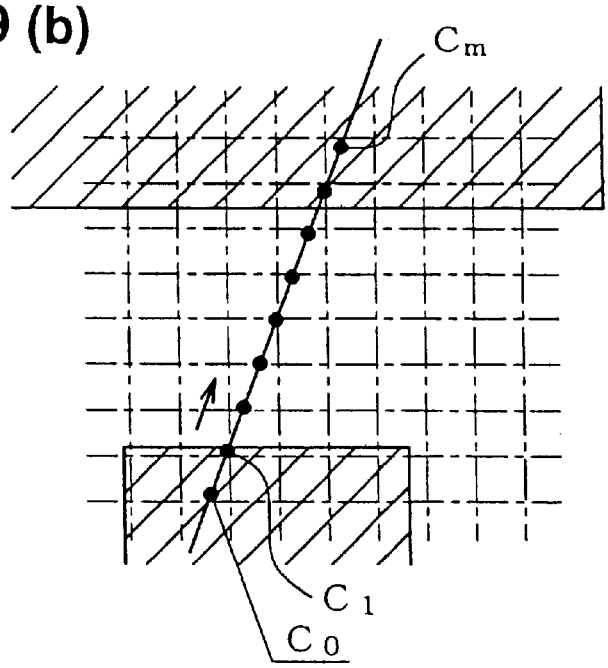
Figure 19:
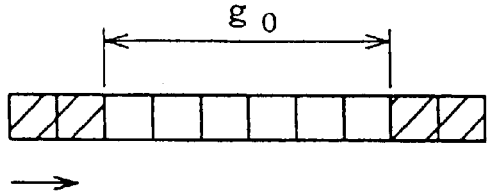
Figure 20:
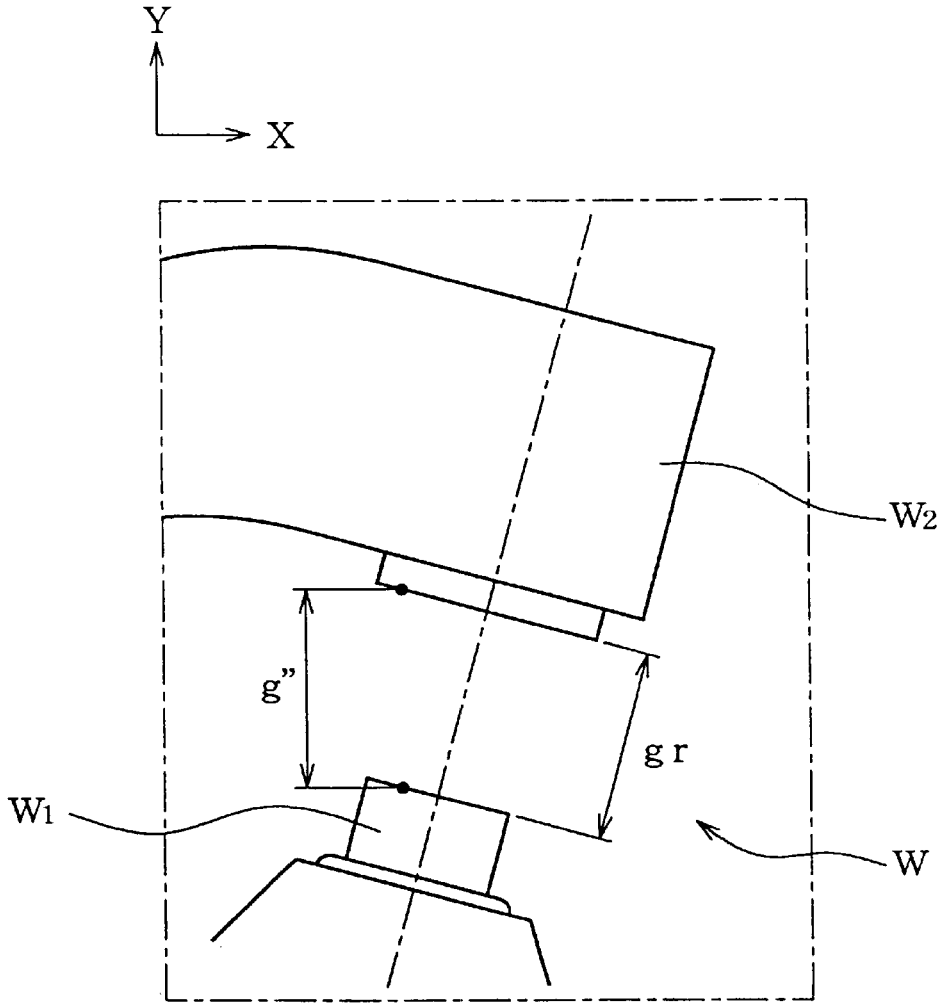
FIG. 20 is an explanatory view showing conceptually a conventional gap measurement.

Subsequently, as shown in FIG. 19(*a*), a reference point $Q_0$ is defined at a predetermined position on a straight line A which crosses the center electrode $W_1$, and a plurality of measurement lines $L_0, L_1, \ldots, L_n$ which pass through the reference point $Q_0$ are set radially. Notably, the predetermined position is set within the dark portion corresponding to the center electrode $W_1$. As shown in FIG. 19(*b*), on each of the measurement lines $L_0, L_1, \ldots, L_n$, a plurality of detection points $c_0, c_1, \ldots, c_m$ are set at intervals equal to the width of each pixel, starting from the reference point $Q_0$, and density (i.e., gray level) at each of the detection points $c_0, c_1, \ldots, c_m$ is read out. Subsequently, a density array as shown in FIG. 19(*c*) is produced for each measurement line, and is digitized to binary data using a predetermined density threshold. Since the size of the space along each measurement line can be determined through calculation by multiplying the width of a single pixel by the number of detection points at which the image has been judged to be light, a temporary gap size go for the reference point $Q_0$ is determined on the basis of the smallest one among the space sizes determined for the plurality of measurement lines. The same procedure is repeated in order to obtain a plurality of temporary gap sizes for a plurality of reference points defined on the straight line A, and the smallest one among the plurality of temporary gap sizes is selected as a gap size g. In the present embodiment, the straight line A is drawn to cross the center electrode $W_1$. However, the straight line A may be drawn to cross the space serving as a spark gap, without crossing the center electrode $W_1$. In this case, the reference point $Q_0$ is preferably determined to be located within an area through which the center electrode $W_1$ faces the ground electrode $W_2$.

It should further be apparent to those skilled in the art that various changes in form and detail of the invention as shown and described above may be made. It is intended that such changes be included within the spirit and scope of the claims appended hereto.

For example, in the above-described embodiments, the shortest distance is selected as a gap size. However, in the case in which measured values include anomalous values due to various factors, the gap size may be determined from the shortest distance which is determined after exclusion of such anomalous values. Further, the above-described embodiments may be modified in such manner that the gap size is adjusted to fall within a predetermined range with reference to the largest one among the shortest distances corresponding to the plurality of reference points.

This application is based on Japanese Patent Application No. 2001-32271 filed Feb. 8, 2001, the disclosure of which is incorporated herein by reference in its entirety.

What is claimed is:

1. A method for manufacturing a spark plug comprising a center electrode disposed within an insulator, a metallic shell disposed outside the insulator, and a ground electrode, one end of the ground electrode being joined to an end face of the metallic shell, an opposite end portion of the ground electrode being bent such that a side surface of the opposite end portion faces an end face of the center electrode so as to form a spark gap between the side surface and the end face, said method comprising:

a photographing step for photographing the spark gap by use of photographing means;

a gap calculation step for determining a gap which comprises defining a reference point on the basis of image information obtained from said photographing step, defining a plurality of measurement lines passing through the reference point, measuring along each of the measurement lines a distance between a ground electrode spark gap definition portion of the ground electrode facing the spark gap and a center electrode spark gap definition portion of the center electrode facing the spark gap, and determining a gap on the basis of the measured distance; and an after-treatment step for performing a predetermined after-treatment on the basis of the calculated gap.

2. The method for manufacturing a spark plug as claimed in claim 1, wherein said gap calculation step comprises defining a plurality of reference points, and determining the gap on the basis of the distances obtained for each of the reference points.

3. A method for manufacturing a spark plug comprising a center electrode disposed within an insulator, a metallic shell disposed outside the insulator, and a ground electrode, one end of the ground electrode being joined to an end face of the metallic shell, an opposite end portion of the ground electrode being bent such that a side surface of the opposite end portion faces an end face of the center electrode so as to form a spark gap between the side surface and the end face, said method comprising:

a photographing step for photographing the spark gap by use of photographing means;

a gap calculation step for determining a gap which comprises determining, on the basis of image information obtained from said photographing step, a single reference point on an outline of either a ground electrode spark gap definition portion of the ground electrode facing the spark gap or a center electrode spark gap definition portion of the center electrode facing the spark gap, finding a measurement point on the outline of the other spark gap definition portion such that a distance between the reference point and the measurement point is the shortest, and determining the gap on the basis of the shortest distance; and an after-treatment step for performing a predetermined after-treatment on the basis of the calculated gap.

4. The method for manufacturing a spark plug as claimed in claim 3, wherein said gap calculation step further comprises determining a plurality of reference points, obtaining the minimum distance between each of the reference points and a measurement point on the outline of the other spark gap definition portion, and determining the gap on the basis of a minimum value among the thus-obtained plurality of minimum distances.

5. The method for manufacturing a spark plug as claimed in claim 3, wherein said gap calculation step further comprises:

obtaining, on the basis of the shortest distance, an apparent gap size as observed on an image obtained from said photographing step; and correcting the apparent gap size on the basis of an apparent dimension of a predetermined measurement reference portion of the spark plug as observed on the image and a known standard dimension of the measurement reference portion, to thereby calculate the gap.

6. A method for manufacturing a spark plug comprising a center electrode disposed within an insulator, a metallic shell disposed outside the insulator, and a ground electrode, one end of the ground electrode being joined to an end face of the metallic shell, an opposite end portion of the ground electrode being bent such that a side surface of the opposite end portion faces an end face of the center electrode so as to form a spark gap between the side surface and the end face, said method comprising:

a photographing step for photographing the spark gap by use of photographing means;

a gap calculation step for calculating a gap serving as the spark gap which comprises obtaining an apparent gap size on the basis of image information obtained from said photographing step, and correcting the apparent gap size on the basis of an apparent dimension of a predetermined measurement reference portion of the spark plug as observed on an image obtained from said photographing step and a known standard dimension of the measurement reference portion, to thereby calculate the gap; and an after-treatment step for performing a predetermined after-treatment on the basis of the calculated gap.

7. The method for manufacturing a spark plug as claimed in claim 5, wherein said gap calculation step comprises correcting a dimensional error in the apparent gap size associated with the spark plug being photographed while being inclined along a direction of photographing by said photographing means, on the basis of the measurement reference portion apparent-dimension and the measurement reference portion standard-dimension.

8. The method for manufacturing a spark plug as claimed in claim 6, wherein said gap calculation step comprises correcting a dimensional error in the apparent gap size associated with the spark plug being photographed while being inclined along a direction of photographing by said photographing means, on the basis of the measurement reference portion apparent-dimension and the measurement reference portion standard-dimension.

9. The method for manufacturing a spark plug as claimed in claim 5, wherein the measurement reference portion is the ground electrode;

said method comprising predetermining a known standard thickness of the ground electrode as the measurement reference portion standard-dimension, obtaining a thickness of the ground electrode as observed on the image as the measurement reference portion apparent-dimension, and correcting the apparent gap size on the basis of the ground electrode apparent-thickness, the ground electrode standard-thickness, and a predetermined, known standard width of the ground electrode.

10. The method for manufacturing a spark plug as claimed in claim 6, wherein the measurement reference portion is the ground electrode;

said method comprising predetermining a known standard thickness of the ground electrode as the measurement reference portion standard-dimension, obtaining a thickness of the ground electrode as observed on the image as the measurement reference portion apparent-dimension, and correcting the apparent gap size on the basis of the ground electrode apparent-thickness, the ground electrode standard-thickness, and a predetermined, known standard width of the ground electrode.

11. The method for manufacturing a spark plug as claimed in claim 7, wherein the measurement reference portion is the ground electrode;

said method comprising predetermining a known standard thickness of the ground electrode as the measurement reference portion standard-dimension, obtaining a thickness of the ground electrode as observed on the image as the measurement reference portion apparent-dimension, and correcting the apparent gap size on the basis of the ground electrode apparent-thickness, the ground electrode standard-thickness, and a predetermined, known standard width of the ground electrode.

12. The method for manufacturing a spark plug as claimed in claim 1, wherein said gap calculation step includes:

an electrode edge line determination step for determining a tip edge line of the ground electrode facing the spark gap and a tip edge line of the center electrode from an image obtained from said photographing step; and a smoothing step for performing predetermined smoothing processing on information about the tip edge line of the ground or center electrode or information about the tip edge lines of the ground and center electrodes, the information being obtained from the image, in order to lessen the influence of a fine projection, formed on either or both of a tip surface of the ground electrode and a tip surface of the center electrode; and calculating the spark gap by use of thus-smoothed edge line information.

13. The method for manufacturing a spark plug as claimed in claim 3, wherein said gap calculation step includes:

an electrode edge line determination step for determining a tip edge line of the ground electrode facing the spark gap and a tip edge line of the center electrode from an image obtained from said photographing step; and a smoothing step for performing predetermined smoothing processing on information about the tip edge line of the ground or center electrode or information about the tip edge lines of the ground and center electrodes, the information being obtained from the image, in order to lessen the influence of a fine projection, formed on either or both of a tip surface of the ground electrode and a tip surface of the center electrode; and calculating the spark gap by use of thus-smoothed edge line information.

14. The method for manufacturing a spark plug as claimed in claim 6, wherein said gap calculation step includes:

an electrode edge line determination step for determining a tip edge line of the ground electrode facing the spark gap and a tip edge line of the center electrode from an image obtained from said photographing step; and a smoothing step for performing predetermined smoothing processing on information about the tip edge line of the ground or center electrode or information about the tip edge lines of the ground and center electrodes, the information being obtained from the image, in order to lessen the influence of a fine projection, formed on either or both of a tip surface of the ground electrode and a tip surface of the center electrode; and calculating the spark gap by use of thus-smoothed edge line information.

15. An apparatus for manufacturing a spark plug comprising a center electrode disposed within an insulator, a metallic shell disposed outside the insulator, and a ground electrode, one end of the ground electrode being joined to an end face of the metallic shell, an opposite end portion of the ground electrode being bent such that a side surface of the opposite end portion faces an end face of the center electrode so as to form a spark gap between the side surface and the end face, said apparatus comprising:

photographing means for photographing the spark gap;

gap calculation means for determining a gap by defining a reference point on the basis of image information obtained from said photographing step, defining a plurality of measurement lines passing through the reference point, measuring along each of the measurement lines a distance between a ground electrode spark gap definition portion of the ground electrode facing the spark gap and a center electrode spark gap definition portion of the center electrode facing the spark gap, and determining a gap on the basis of the measured distance; and after-treatment means for performing a predetermined after-treatment on the basis of the calculated gap.

16. An apparatus for manufacturing a spark plug comprising a center electrode disposed within an insulator, a metallic shell disposed outside the insulator, and a ground electrode, one end of the ground electrode being joined to an end face of the metallic shell, an opposite end portion of the ground electrode being bent such that a side surface of the opposite end portion faces an end face of the center electrode so as to form a spark gap between the side surface and the end face, said apparatus comprising:

photographing means for photographing the spark gap;

gap calculation means for determining a gap by determining, on the basis of image information obtained through the photographing, a single reference point on an outline of either a ground electrode spark gap definition portion of the ground electrode facing the spark gap or a center electrode spark gap definition portion of the center electrode facing the spark gap, finding a measurement point on the outline of the other spark gap definition portion such that a distance between the reference point and the measurement point is the shortest, and determining the gap on the basis of the shortest distance; and after-treatment means for performing a predetermined after-treatment on the basis of the calculated gap.

* * * * *